US007710373B2

(12) United States Patent
Nose

(10) Patent No.: US 7,710,373 B2
(45) Date of Patent: May 4, 2010

(54) LIQUID CRYSTAL DISPLAY DEVICE FOR IMPROVED INVERSION DRIVE

(75) Inventor: Takashi Nose, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1063 days.

(21) Appl. No.: 11/398,547

(22) Filed: Apr. 6, 2006

(65) Prior Publication Data

US 2006/0227092 A1 Oct. 12, 2006

(30) Foreign Application Priority Data

Apr. 7, 2005 (JP) ..... 2005-111439

(51) Int. Cl.
*G09G 3/36* (2006.01)

(52) U.S. Cl. ..... 345/87; 345/55; 345/204

(58) Field of Classification Search ..... 345/87, 345/55, 204
See application file for complete search history.

(56) References Cited

U.S. PATENT DOCUMENTS 6,784,866 B2 * 8/2004 Udo et al. ..... 345/100

FOREIGN PATENT DOCUMENTS

| | | | |
|---|---|---|---|
| JP | 05-41651 | | 2/1993 |
| JP | 05-041651 | * | 2/1993 |
| JP | 11-95729 | | 4/1999 |
| JP | 2002-62855 | | 2/2002 |
| JP | 2004-045839 | | 2/2004 |

* cited by examiner

*Primary Examiner*—Richard Hjerpe
*Assistant Examiner*—Leonid Shapiro
(74) *Attorney, Agent, or Firm*—McGinn IP Law Group PLLC

(57) ABSTRACT

A liquid crystal display device is composed of first and second data lines, first and second operational amplifiers, and a short-circuiting circuit. The first operational amplifier is configured to drive the first data line to a potential of a first polarity during a first period, and to drive the second data line to a potential to the first polarity during a second period following the first period. The second operational amplifier is configured to drive the second data line to a potential of a second polarity complementary to the first polarity during the first period, and to drive the first data line to a potential to the second polarity during the second period. The short-circuiting circuit is configured to short-circuit the first and second data lines during a short-circuiting period between the first and second periods. Drive capabilities of the first and second operational amplifiers are controlled in response to a short-circuit potential of the first and second data lines during the short-circuiting period.

15 Claims, 15 Drawing Sheets

$$AS_{j,2k-1} = \left| \left( \sum_{i=1}^{i=n/2} D_{j-1,2i-1} - D_{j-1,2i} \right) / n - D_{j,2k-1} \right|$$

$$AS_{j,2k} = \left| \left( \sum_{i=1}^{i=n/2} D_{j-1,2i} - D_{j-1,2i-1} \right) / n - D_{j,2k} \right|$$

LIQUID CRYSTAL DISPLAY DEVICE FOR IMPROVED INVERSION DRIVE

BACKGROUND OF THE INVENTION

1. Field of the Invention

The present invention relates to a liquid crystal display (LCD) device, a liquid crystal driver and a method for driving an LCD panel, and in particular a technique to drive the LCD panel by an inversion drive method.

2. Description of the Related Art

The inversion drive is regarded as one of the techniques that are widely used to drive the liquid crystal display panel. The inversion drive is a driving method which inverts the polarities of data signals provided to data lines (or signal lines) at appropriate time and spatial intervals in order to prevent image "burn-in" of the LCD panel. The inversion drive reduces DC components of drive voltages applied to the liquid crystal capacitors within respective pixels, and effectively prevents the image "burn-in" phenomenon.

The inversion drive includes two kinds of methods: a common constant driving method and a common inversion driving method. The common constant drive method involves inverting the polarities of data signals while sustaining the potential level of a common electrode (or an opposite electrode) unchanged; the potential level of the common electrode is referred to as the common potential $V_{COM}$, hereinafter. On the other hand, the common inversion drive method is a driving method which inverts both the data signal and the common potential $V_{COM}$. The common constant drive method has an advantage of excellent stability in the common potential $V_{COM}$ compared to the common inversion driving method. As well-known to those skilled in the art, the stability of the common potential $V_{COM}$ is important in terms of suppressing flickers.

One of the typical common constant driving methods is a dot inversion drive in which the polarities of data signals applied to respective pixels are spatially inverted with respect to both horizontal and vertical directions. It should be noted that the polarities of the data signals are defined with respect to the common electrical potential $V_{COM}$ in this specification. The dot inversion drive further improves the stability of the common potential $V_{COM}$, and effectively suppressing the flickers. Most typically, the spatial interval in which the polarities of the data signals are inverted is one pixel with respect to both the horizontal and vertical directions. However, the dot inversion drive in this specification should be understood as including the case that the spatial interval in which the polarities of data signals are inverted is two or more pixels, and the case that the spatial interval in which the polarities of data signals is inverted is different between the horizontal direction and the vertical direction.

In the dot inversion drive, the potential levels of the data lines are inverted in order to invert the data signals written into the pixels with respect to the vertical direction. The polarities of the potential levels of the data lines when the data signals are written into pixels in a specific horizontal line are opposite to the polarities of the potential levels of the data lines when the data signals are applied to pixels in the adjacent horizontal line.

A problem accompanied by the inversion of the potential level of the data lines is that increased power is required to invert the potential levels of the data lines due to an extremely large capacity of the data lines, which will undesirably cause the increase of power consumption in liquid crystal display devices. The increased power consumption to invert the potential level of the data lines is one of the serious problems, particularly in a liquid crystal display device within a cellular phone terminal.

One approach has been proposed as a technique to suppress the power consumption in the liquid crystal display devices, which involves short-circuiting data lines before inverting the potential levels of the data lines. Japanese Laid-Open Patent Application No. Jp-A Heisei 11-95729, for example, discloses a technique in which adjacent data lines are short-circuited before inverting the potential levels of the data lines within the liquid crystal display device adapted to dot inversion drive with the spatial interval to invert the data signals configured to one pixel. Short-circuiting the data lines effectively allows electric charges accumulated in the data lines to be effectively utilized, and thereby suppresses the power consumption in the liquid crystal display device. Japanese Laid-Open Patent Application No. Jp-A 2002-62855 also discloses a technique in which data lines are not short-circuited in a non-inverting period during which the polarities of potential levels of data lines are not inverted for the further suppressing the power consumption.

Another important factor to suppress the power consumption of the liquid crystal display device is reduction of power consumption in operational amplifiers used for driving data lines.

The techniques disclosed in these patent applications, however, suffer from a problem of useless power consumption in the operational amplifiers. This is because the driving capabilities of the operational amplifiers are not controlled in the disclosed liquid crystal drivers. In an architecture of the liquid crystal drivers in which a pair of data lines are short-circuited before inverting the potential levels of the pair of data lines, the operational amplifiers need to have a sufficient drive capability to charge (or discharge) the respective data lines from an average potential level of the pair of the data lines to the potential levels indicated by the associated pixel data. Accordingly, when the difference between the average potential level of the pair of the above data lines and the potential levels indicated by the pixel data is small, the drive capability of the operational amplifiers should be small; however, the liquid crystal drivers disclosed in the above-mentioned patent applications do not have function of controlling the drive capability of the operational amplifiers. In the conventional techniques, the operational amplifiers are required to be designed with a drive capability to cope with a maximum difference between the average electrical potential of the pair of the data lines and the electrical potentials indicated by the with the pixel data. This undesirably increases power consumption of the operational amplifiers.

With respect to the above-described problem, techniques are disclosed which reduce power consumption of the operational amplifiers by controlling the drive capability and the use/no-use in the operational amplifiers. Japanese Laid-Open Patent Application No. Jp-A Heisei 5-41651, for example, discloses a technique in which a drive capability of each amplifier is controlled in response to a difference between an output signal provided from the operational amplifier and an input signal voltage. In this technique, the drive capabilities of respective operational amplifiers are increased when a difference between the output signal and the input signal voltage is large, and the drive capabilities of the operational amplifiers are decreased for a small difference. Since reduction in the drive capability effectively reduces power consumption of the operational amplifiers, the power consumption of operational amplifiers is suppressed by reducing the driving capabilities of the operational amplifiers when a large drive capability is not required.

Japanese Laid-Open Patent Application No. Jp-A 2004-45839 further discloses a technique to deactivate operational amplifiers in response to pixel data associated with pixels in the horizontal line and pixel data of the corresponding pixels in the adjacent horizontal line. More specifically, this patent application discloses that data lines are driven by D/A converters without using operational amplifiers when the pixel data of all the pixels in the horizontal line are identical to the pixel data of the corresponding pixels in the adjacent horizontal line. When the pixel data of one pixel in a horizontal line is detected as being different from that of the corresponding pixel in the adjacent horizontal line, the operational amplifiers are used to drive the data lines.

However, these techniques do not provide a technique for controlling the drive capability of the operational amplifiers suitable for architecture in which the data lines are short-circuited before driving data lines.

SUMMARY OF THE INVENTION

In an aspect of the present invention, a liquid crystal display device is composed of first and second data lines, first and second operational amplifiers, and a short-circuiting circuit. The first operational amplifier is configured to drive the first data line to a potential of a first polarity during a first period, and to drive the second data line to a potential of the first polarity during a second period following the first period. The second operational amplifier is configured to drive the second data line to a potential of a second polarity complementary to the first polarity during the first period, and to drive the first data line to a potential of the second polarity during the second period. The short-circuiting circuit is configured to short-circuit the first and second data lines during a short-circuiting period between the first and second periods. Drive capabilities of the first and second operational amplifiers are controlled in response to a short-circuit potential of the first and second data lines during the short-circuiting period.

The liquid crystal display device thus constructed controls the drive capabilities of the first and second operational amplifiers in response to the potential of the first and second data lines when the first and second data lines are short-circuited, and thereby effectively reduces the power consumption.

More specifically, the drive capability of the first operational amplifier during the second period is controlled in response to a difference between the short-circuit potential and a potential to which the second data line is driven during the second period, and the drive capability of the second operational amplifier during the second period is controlled in response to a difference between the short-circuit potential and a potential to which the first data line is driven during the second period. Such architecture allows driving the first and second data lines with large drive capability when the differences between the short-circuit potential and the potentials to which the first and second data lines are to be driven are large, and vice versa.

The control based on the differences between the short-circuit potential and the potentials to which the first and second data lines are to be driven may be achieved in response to pixel data. For example, when the first operational amplifier is responsive to first pixel data for driving the first data line during the first period, and is responsive to second pixel data for driving the second data line during the second period, and the second operational amplifier is responsive to third pixel data for driving the second data line during the first period, and is responsive to fourth pixel data for driving the first data line during the second period, it is preferable that the drive capability of the first operational amplifier during the second period is controlled in response to the second pixel data in addition to the short-circuit potential, and the drive capability of the second operational amplifier during the second period is controlled in response to the fourth pixel data in addition to the short-circuit potential.

In a preferred embodiment, the drive capability of the first operational amplifier during the second period may be controlled in response to the first and third pixel data in addition to the second pixel data, and the drive capability of the second operational amplifier during the second period may be controlled in response to the first and third pixel data in addition to the fourth pixel data. The use of the pixel data is preferable for facilitating the control of the drive capabilities.

In another aspect of the present invention, a liquid crystal display device is composed of first and second data lines; first and second operational amplifiers, and a short-circuiting circuit. The first operational amplifier is responsive to first pixel data for providing a data signal of a first polarity for one of the first and second data lines during a first period, and is responsive to second pixel data for providing a data signal of the first polarity for another of the first and second data lines during a second period following the first period. The second operational amplifier is responsive to third pixel data for providing a data signal of a second polarity complementary to the first polarity for the other of the first and second data lines during the first period, and is responsive to second pixel data for providing a data signal of the second polarity for the one of the first and second data lines. The short-circuiting circuit is configured to short-circuit the first and second data lines during a short-circuiting period between the first and second periods. Drive capabilities of the first and second operational amplifiers are controlled in response to the first and third pixel data.

The liquid crystal display device thus constructed can recognize the short-circuit potential of the first and second data lines during the short-circuiting period from the first and third pixel data, and configure the first and second operational amplifiers with appropriate drive capabilities in accordance with the short-circuit potential. This effectively reduces the power consumption of the liquid crystal display device.

As thus described, the present invention effectively reduces the power consumption of a liquid crystal display device adopting dot inversion drive in which data lines are short-circuited before respective data lines are driven.

BRIEF DESCRIPTION OF THE DRAWINGS

The above and other advantages and features of the present invention will be more apparent from the following description taken in conjunction with the accompanied drawings, in which.

DESCRIPTION OF THE PREFERRED EMBODIMENTS

Figure 1:
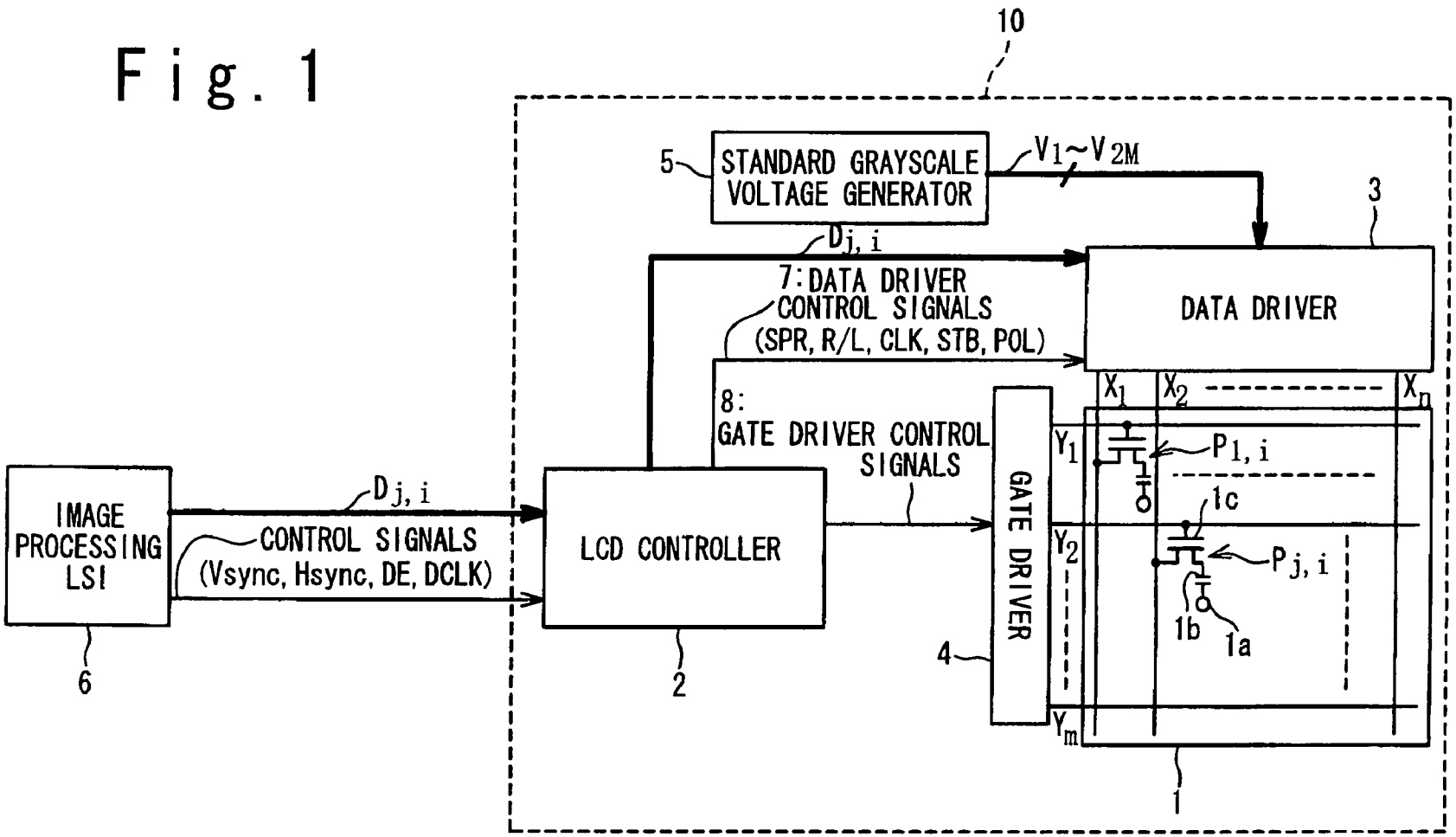
FIG. 1 is a block diagram illustrating a structure of a liquid crystal display device in a first embodiment of the present invention.

The invention will be now described herein with reference to illustrative embodiments. Those skilled in the art would recognize that many alternative embodiments can be accomplished using the teachings of the present invention and that the invention is not limited to the embodiments illustrated for explanatory purposed. It should be noted that same or similar reference numerals denote same, corresponding or similar elements in the drawings.

First Embodiment

1. Overall Structure of LCD Device

FIG. 1 is a block diagram illustrating a structure of a liquid crystal display device 10 in a first embodiment of the present invention. The liquid crystal display device 10 is composed of an LCD (liquid crystal display) panel 1, an LCD controller 2, a plurality of data drivers 3 (one shown), a gate driver 4 and a standard grayscale voltage generator 5. The LCD panel 1 includes data lines $X_1$ to $X_n$ (n is an even number of 2 or more), gate lines $Y_1$ to $Y_m$ (m is a natural number of 2 or more) and pixels P provided at respective intersections of the data lines and the gate lines. For better understanding the figure, only two of the pixels are shown in FIG. 1. In the following explanations, a pixel provided at an intersection of the data line $X_j$ and the gate line $Y_1$ is referred to as pixel $P_{j,i}$. Each pixel $P_{j,i}$ has a pixel electrode 1*b* opposed to a common electrode 1*a* and a TFT (thin film transistor) 1*c*. When a data signal is provided onto the data line $X_j$ with the TFT 1*c* of the pixel $P_{j,i}$ turned on, the data signal is applied to a liquid crystal capacitor within the pixel $P_{j,i}$ (that is, a capacitor composed of the common electrode 1*a* and the pixel electrode 1*b*).

The LCD controller 2 controls the data drivers 3 and the gate driver 4 to display a desired image on the LCD panel 1. In detail, the LCD controller 2 receives pixel data from an image processing LSI 6 such as a CPU (central processor unit) and a DSP (digital signal processor), and transfers the received pixel data to the data drivers 3. The pixel data indicate graylevels of the respective pixels of the LCD panel 1. The pixel data associated with the pixel $P_{j,i}$ is referred to as pixel data $D_{j,I}$, hereinafter. The LCD controller 2 additionally receives various control signals from the image processing LSI 6, including a vertical sync signal $V_{sync}$, a horizontal sync signal $H_{sync}$, a data enable signal DE, a clock signal DCLK and other control signals, and generates data driver control signals 7 for controlling the data drivers 3, and gate driver control signals 8 for controlling the gate driver 4, in response to the control signals received from the image processing LSI 6. In this embodiment, the data driver control signals 7 include a start pulse signal SPR, a shift direction instructing signal R/L, a clock signal CLK, a latch signal STB, and a polarity signal POL. The start pulse signal SPR is a signal allowing the data drivers 3 to latch the pixel data, and the shift direction instructing signal R/L is used to control the latching of the pixel data by the data drivers 3. The latch signal STB is used to control data transfer within the data drivers 3, and the polarity signal POL is used to determine the polarities of the data signals fed to the respective data lines.

Each data driver 3 are designed to drive the data lines $X_1$ to $X_n$ within the LCD panel 1 in response to the pixel data received form the LCD controller 2 and the data driver control signals 7. In detail, during a j-th horizontal period in which pixels $P_{j,1}$ to $P_{j,n}$ of a j-th line are driven, the data driver 3 drives the data line $X_1$ to $X_n$ in response to pixel data $D_{j,1}$ to $D_{j,n}$, respectively. Grayscale voltages $V_1$ to $V_{2M}$ received from the standard grayscale voltage generator 5 are used to drive the data line $X_1$ to $X_n$. M is a number of allowed grayscale levels of the pixels. When the pixel data $D_{j,i}$ is p-bit data, M is 2p. The grayscale voltages $V_1$ to $V_M$ have a positive polarity with respect to the common potential $V_{COM}$ (i.e. the potential of the common electrode 1*a*), satisfying the following formula:

$$V_1 > V_2 > \ldots > V_M > 0.$$

Meanwhile, grayscale voltages $V_{N+1}$ to $V_{2M}$ have a negative polarity, satisfying the following formula:

$$0 > V_{M+1} > V_{M+2} > \ldots > V_{2M}.$$

When the data lines $X_1$ to $X_n$ are driven to the positive potential levels, grayscale voltages are selected from the grayscale voltages $V_1$ to $V_M$ for the respective data lines $X_1$ to $X_n$, so that the data lines $X_1$ to $X_n$ are driven to the positive potential levels corresponding to the selected grayscale voltages. When the data lines $X_1$ to $X_n$ are driven to the negative potential levels, grayscale voltages are selected from the grayscale voltages $V_{M+1}$ to $V_{2M}$ for the respective data lines $X_1$ to $X_n$ so that the data lines $X_1$ to $X_n$ are driven to the negative potential levels corresponding to the selected grayscale voltages.

The gate driver 4 drives the gate lines $Y_1$ to $Y_m$ in response to the gate driver control signals 8 received from the LCD controller 2.

2. Configuration of Data Driver

Figure 2:
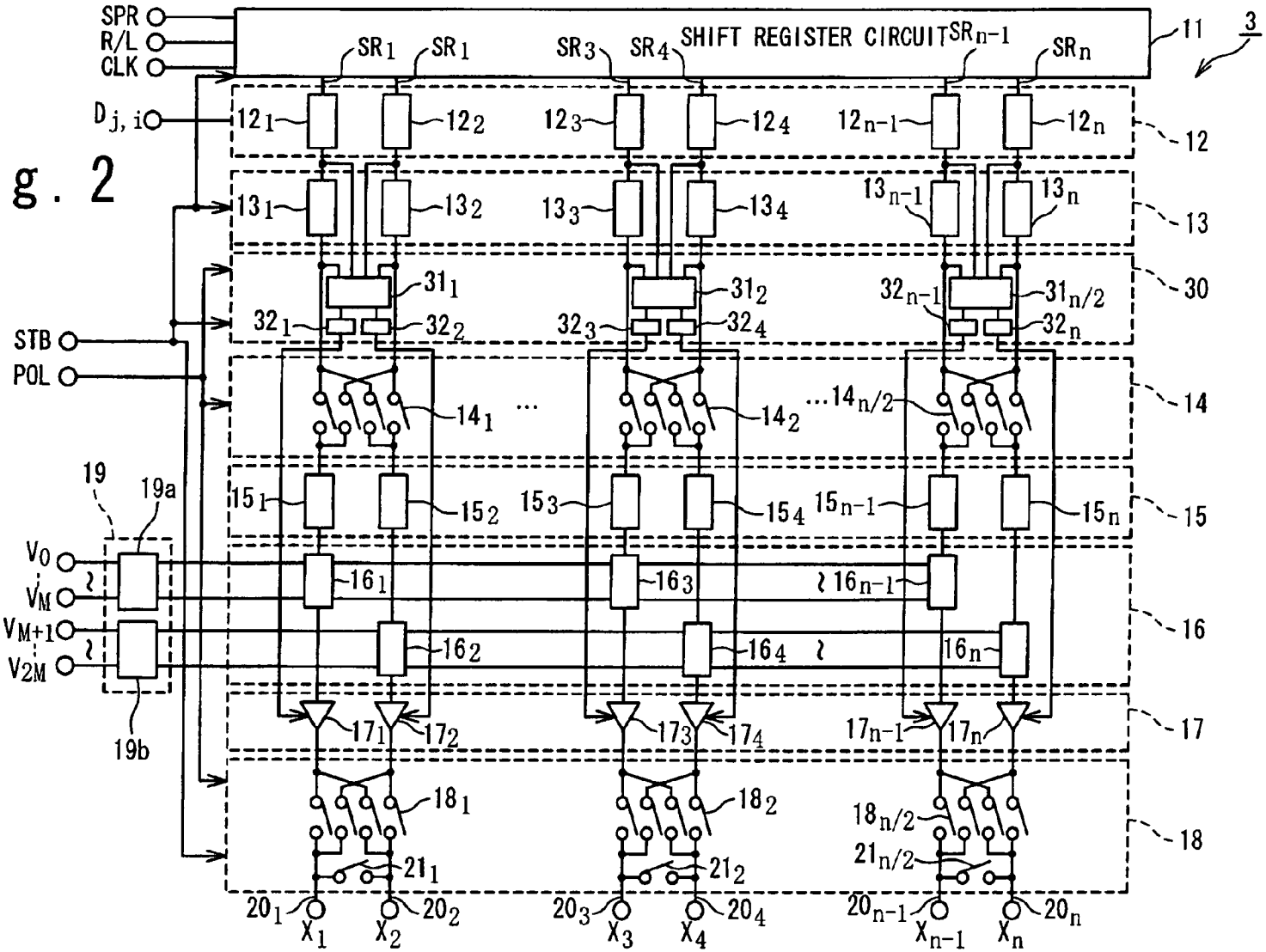
FIG. 2 is a block diagram illustrating a structure of a data driver of the liquid crystal display device in the first embodiment.

FIG. 2 is a block diagram illustrating a structure of the data drivers 3. The data drivers 3 are designed to be adapted to a dot inversion drive in which polarities of the data signals are inverted with spatial intervals of one pixel. In other words, the data driver 3 is configured to drive a pair of data lines $X_{2k-1}$ and $X_{2k}$ with data signals of opposite polarities.

More specifically, each data driver 3 includes a shift register circuit 11, a data register circuit 12, a latch circuit 13, a drive capability switching circuit 30, an input-side switch circuitry 14, a level shift circuit 15, a decoder (D/A converter) 16, a driver output stage 17, an output-side switch circuitry 18, a grayscale voltage buffer 19 and output terminals 20, to 20, that are connected to the data lines $X_1$ to $X_n$, respectively. The data register circuit 12 includes registers $\mathbf{12}_1$ to $\mathbf{12}_n$, and the latch circuit 13 includes latches $\mathbf{13}_1$ to $\mathbf{13}_n$ connected to the outputs of registers $\mathbf{12}_1$ to $\mathbf{12}_n$, respectively. The input-side switch circuitry 14 includes switch circuits $\mathbf{14}_1$ to $\mathbf{14}_{n/2}$. One switch circuit $\mathbf{14}_i$ is provided for every two latches $\mathbf{13}_{2i-1}$, and $\mathbf{13}_{2i}$. The level shift circuit 15 includes level shifters $\mathbf{15}_1$ to $\mathbf{15}_n$. The decoder 16 includes selectors $\mathbf{16}_1$ to $\mathbf{16}_n$ that are connected to the outputs of the level shifters $\mathbf{15}_1$ to $\mathbf{15}_n$. The driver output stage 17 includes operational amplifiers $\mathbf{17}_1$ to $\mathbf{17}_n$. The output-side switch circuitry 18 includes switch circuits $\mathbf{18}_1$ to $\mathbf{18}_{n/2}$, One switch circuit $\mathbf{17}_i$ is provided for every two operational amplifiers $\mathbf{18}_{2i-1}$ and $\mathbf{18}_{2i}$. The output-side switch circuitry 18 further includes short-circuit switches $\mathbf{21}_1$ to $\mathbf{21}_{n/2}$. One of short-circuit switch 21*i* is provided for every two output terminals 20. The grayscale voltage buffer 19 includes voltage followers 19*a* and 19*b*.

The shift register circuit 11 is designed to generate trigger pulse signals $SR_1$ to $SR_n$ to allow the data register circuit 12 to latch the pixel data. The shift register circuit 11 sequentially activates the trigger pulse signals $SR_1$ to $SR_n$ during each horizontal period. More specifically, the shift register circuit 11 is composed of n-bit shift registers having parallel outputs, operating in response to the start pulse signal SPR, the shift direction instructing signal R/L and the clock signal CLK. When the start pulse signal SPR is activated, a bit of logical "1" is shifted within the shift register circuit 11 in a direction indicated by the shift direction instructing signal R/L, in synchronization with the clock signal CLK, so that the trigger pulse signals SR, to SR, sequentially activated when associated bits take logical "1". When the shift direction instructing signal R/L is placed in the "H" level, the trigger pulse signals $SR_1$, $SR_2$, . . . $SR_n$ are activated in this order. When the shift direction instructing signal R/L is placed in the "L" level, the trigger pulse signals are activated in the opposite order. Since the LCD panel 1 is driven by the multiple data drivers 3, a specific data driver 3 is designed to activate a start pulse signal SPL at the same timing as the trigger pulse signal $SR_n$, and to feed the start pulse signal SPL to the adjacent data driver 3. The adjacent data driver 3 uses the start pulse signal SPL received as the start pulse signal SPR therewithin.

The data register circuit 12 latches the pixel data received from an LCD controller 2 into the registers $\mathbf{12}_1$ to $\mathbf{12}_n$, in response to the trigger pulse signals $SR_1$ to $SR_n$, respectively. In detail, the pixel data $D_{j,1}$ to $D_{j,n}$ associated with the pixels $P_{j,1}$ to $P_{j,n}$ in the j-th line are latched into the registers $\mathbf{12}_1$ to $\mathbf{12}_n$, respectively in response to the trigger pulse signals $SR_1$ to $SR_n$.

The latch circuit 13 is responsive to the latch signal STB for latching the pixel data from the data register circuit 12 into the latches $\mathbf{13}_1$ to $\mathbf{13}_n$. The pixel data stored in the latches $\mathbf{13}_1$ to $\mathbf{13}_n$ are used to drive the data lines $X_1$ to $X_n$ in the current horizontal period. It should be noted that the pixel data latched into the data register circuit 12 is a pixel data used to drive the data lines $X_1$ to $X_n$ in the following horizontal period.

Figure 3:
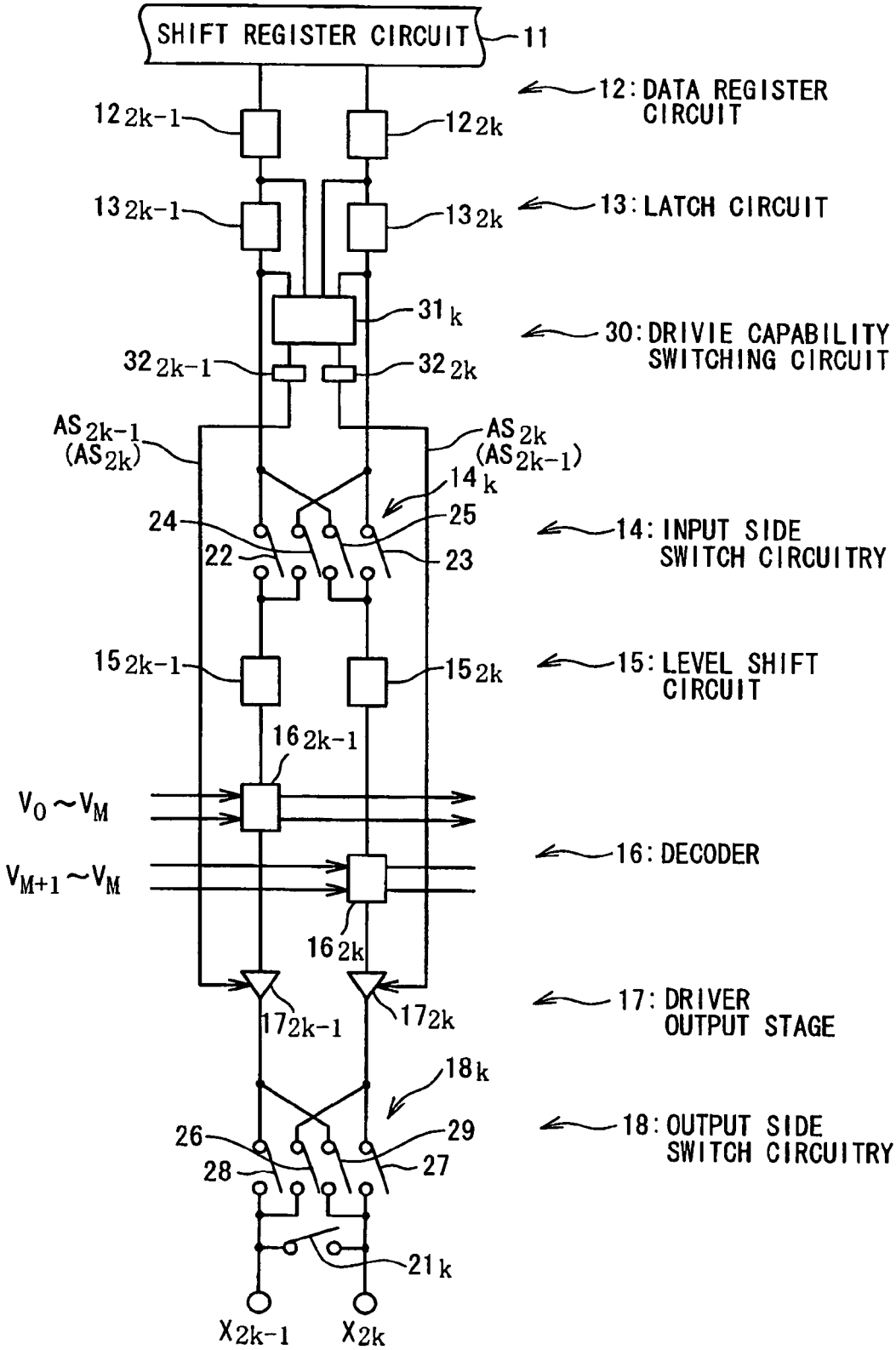
FIG. 3 is a detailed diagram illustrating the structure of the data driver in the first embodiment.

The input-side switch circuitry 14 switches electrical connections between the latches $\mathbf{13}_1$ to $\mathbf{13}_n$ and the level shifters $\mathbf{15}_1$ to $\mathbf{15}_n$ in response to the polarity signal POL. In detail, as shown in FIG. 3, each switch circuit $\mathbf{14}_k$ in the input-side switch circuitry 14 includes four contact switches 22 to 25. The contact switch 22 is connected between the latch $\mathbf{13}_{2k-1}$ and the level shifter $\mathbf{15}_{2k-1}$ and the contact switch 23 is connected between the latch $\mathbf{13}_{2k}$ and the level shifter $\mathbf{15}_{2k}$ on the other hand, the contact switch 24 is connected between the latch $\mathbf{132}_{k-1}$ and the level shifter $\mathbf{15}_{2k}$ and the contact switch 25 is connected between the latch $\mathbf{13}_{2k}$ and the level shifter $\mathbf{15}_{2k-1}$. The switch circuit $\mathbf{14}_k$ thus configured provides electrical connections between one of the latches $\mathbf{13}_{2k-}$ 1 and $\mathbf{13}_{2k}$ and the input of the level shifters $\mathbf{15}_{2k-1}$, and between the other and the input of the level shifter $\mathbf{15}_{2k}$.

Referring back to FIG. 2, the level shift circuit 15, the decoder 16, and the driver output stage 17 are a circuitry which generates data signals in response to the pixel data received from the latches $\mathbf{13}_1$ to $\mathbf{13}_n$. The level shift circuit 15, the decoder 16 and the driver output stage 17 are divided into two sections: a section generating positive data signals and a section generating negative data signals. The odd numbered level shifters $\mathbf{15}_1, \mathbf{15}_3, \ldots \mathbf{15}_{n-1}$, selectors $\mathbf{16}_1, \mathbf{16}_3, \ldots, \mathbf{16}_{n-1}$, and operational amplifier $\mathbf{17}_1$, $\mathbf{17}_3$, . . . $\mathbf{17}_{n-1}$ are used to generate the positive data signals. On the other hand, the even-numbered level shifters $\mathbf{15}_2, \mathbf{15}_4, \ldots \mathbf{15}_n$, selectors $\mathbf{16}_2$, $\mathbf{16}_4, \ldots \mathbf{16}_n$, and operational amplifier $\mathbf{17}_2, \mathbf{17}_4, \ldots, \mathbf{17}_n$ are used to generate the negative data signals.

More specifically, as shown in FIG. 3, the odd-numbered level shifter $\mathbf{15}_{2k-1}$ converts the output signal level of the latch connected thereto (i.e. the latch $\mathbf{13}_{2k-1}$ or the latch $\mathbf{13}_{2k}$) to the input signal level of the selector $\mathbf{16}_{2k-1}$. The selector $\mathbf{16}_{2k-1}$ is provided with the positive grayscale voltages $V_1$ to $V_M$ through the voltage follower 19*a*. The selector $\mathbf{16}_{2k-1}$ selects one of the grayscale voltages $V_1$ to $V_M$ in response to the pixel data received from the latch connected thereto, and provide the selected grayscale voltage to the operational amplifier $\mathbf{17}_{2k-1}$. The grayscale voltage selected by the selector $\mathbf{16}_{2k-1}$ increases as the increase in the value of the associated pixel data (i.e. the grayscale level of the associated pixel). The operational amplifier $\mathbf{17}_{2k-1}$ generates a data signal of a positive level in response to the provided grayscale voltage. The voltage level of the data signal generated by the operational amplifier $\mathbf{17}_{2k-1}$ is increased as the increase in the value of the associated pixel data (i.e. the grayscale level of the associated pixel).

Correspondingly, the even-numbered level shifter $\mathbf{15}_{2k}$ converts the output signal level of the latch connected thereto (i.e. the latch $\mathbf{13}_{2k-1}$ or the latch $\mathbf{13}_{2k}$) to the input signal level of the selector $\mathbf{16}_{2k}$. The selector $\mathbf{16}_{2k}$ is provided with negative grayscale voltages $V_{M+1}$ to $V_{2M}$ ($0>V_{M+1}>V_{M+2}> \ldots >V_{2M}$) through the voltage follower 19*b*. The selector $\mathbf{16}_{2k}$ selects one of the grayscale voltages $V_{M+1}$ to $V_{2M}$ in response to the pixel data received from the latch connected thereto, and provides the selected grayscale voltage to the operational amplifier $\mathbf{17}_{2k}$. The grayscale voltage selected by the selector $\mathbf{16}_{2k-1}$ decreases as the increase in the value of the associated pixel data (i.e. the grayscale level of the associated pixel). The operational amplifier $\mathbf{17}_{2k}$ generates a data signal having a negative level in response to the provided grayscale voltage. The voltage level of the data signal generated by the operational amplifier $\mathbf{17}_{2k}$ decreases as the increase of the value of the associated pixel data (i.e. the grayscale level of the associated pixel).

The output-side switch circuitry 18 switches electrical connections between the outputs of the operational amplifier $\mathbf{17}_1$ to $\mathbf{17}_n$ and the output terminals $\mathbf{20}_1$ to $\mathbf{20}_n$ in response to the polarity signal POL. As shown in FIG. 3, each switch circuit $\mathbf{18}_k$ within the output-side switch 18 includes four contact switches 26 to 29. The contact switch 26 is connected between the operational amplifier $\mathbf{17}_{2k-1}$ and the output terminal $\mathbf{20}_{2k-1}$, and the contact switch 27 is connected between the operational amplifier $\mathbf{17}_{2k}$ and the output terminal $\mathbf{20}_{2k}$. On the other hand, the contact switch 28 is connected between the operational amplifier $\mathbf{17}_{2k-1}$ and the output terminal $\mathbf{20}_{2k}$, and the contact switch 29 is connected between the operational amplifier $\mathbf{17}_{2k}$ and the output terminal $\mathbf{20}_{2k-1}$. The switch circuit $\mathbf{18}_k$ thus configured provides electrical connections between one of the operational amplifiers $\mathbf{17}_{2k-1}$ and $\mathbf{17}_{2k}$ and the output terminals $\mathbf{20}_{2k-1}$, and between the other of the operational amplifier $\mathbf{17}_{2k-1}$ and $\mathbf{17}_{2k}$ and the output terminal $\mathbf{20}_{2k}$.

The output-side switch circuitry 18 is further designed to short-circuit a pair of adjacent output terminals 20 (that is a pair of adjacent data lines). When the latch signal STB is activated during a blanking period which is prepared at the beginning of each horizontal period, the short-circuit switch $\mathbf{21}_k$ in the output-side switch circuitry 18 short-circuits the adjacent output terminals $\mathbf{20}_{2k-1}$ and $\mathbf{20}_{2k}$ (that is, the data lines $X_{2k-1}$ and $X_{2k}$).

In the data drivers 3 thus configured, the polarities of data signals fed to the output terminal $\mathbf{20}_1$ to $\mathbf{20}_n$ (that is, the data lines $X_1$ to $X_n$) are switched in accordance with the polarity signal POL. The polarity switching is achieved by the input-side switch circuitry 14 and the output-side switch circuitry 18. When the polarity signal POL is pulled up to the "H" level, the output-side switch circuitry 18 connects the odd-numbered operational amplifier $\mathbf{17}_1, \mathbf{17}_3, \ldots$ to the odd-numbered output terminals $\mathbf{20}_1, \mathbf{20}_3, \ldots$ (i.e. the odd-numbered data lines $X_1, X_3, \ldots$), and connects the even-numbered operational amplifier $\mathbf{17}_2, \mathbf{17}_4, \ldots$ to the even-numbered output terminals $\mathbf{20}_2, \mathbf{20}_4, \ldots$ (i.e. the even-numbered data lines $X_2, X_4, \ldots$). Therefore, the odd-numbered data lines $X_1, X_3, \ldots$ are driven by positive data signals, and the even-numbered data lines $X_2, X_4, \ldots$ are driven by negative data signals. When the polarity signal POL is pulled-down to the "L" level, the connections are switched vice versa. The input-side switch circuitry 14 switches the electrical connections between the latches $\mathbf{13}_1$ to $\mathbf{13}_n$ and the selectors $\mathbf{16}_1$ to $\mathbf{16}_n$ in accordance with the connections between the outputs of the operational amplifiers $\mathbf{17}_1$ to $\mathbf{17}_n$ and the data lines $X_1$ to $X_n$. Among the pixel data stored in the latches $\mathbf{13}_1$ to $\mathbf{13}_n$, the pixel data associated with to the data lines driven by the positive data signals are transferred to the-odd numbered selectors $\mathbf{16}_1, \mathbf{16}_3, \ldots$, and the pixel data associated with the data lines driven by the negative data signals are transferred to the even-numbered selectors $\mathbf{16}_2, \mathbf{16}_4, \ldots$. The input-side switch circuitry 14 is operated to achieve such connection switching.

In one aspect, the liquid crystal display device 10 in this embodiment is directed to optimize the control of the drive capabilities of the operational amplifiers $\mathbf{17}_1$ to $\mathbf{17}_n$ within the data drivers 3 for reducing power consumption of the liquid crystal display device 10. More specifically, the drive capabilities of the operational amplifiers $\mathbf{17}_{2k-1}$ and $\mathbf{17}_{2k}$ are optimized so as to be driven in accordance with the potential level of the data lines $X_{2k-1}$ and $X_{2k}$ when the data lines $X_{2k-1}$ and $X_{2k}$ are short-circuited during the blanking period within each horizontal period, in this embodiment.

In detail, the drive capability of the operational amplifier $\mathbf{17}_{2k-1}$ (or the operational amplifier $\mathbf{17}_{2k}$) which drives the data line $X_{2k-1}$ is reduced in the case that the difference is small between the potential level of the data lines $X_{2k-1}$ and $X_{2k}$ when the data lines $X_{2k-1}$ and $X_{2k}$ are short-circuited, and the potential level to which the data line $X_{2k-1}$ should be driven thereafter. This effectively avoids unnecessary power consumption in the operational amplifier $\mathbf{17}_{2k-1}$ Correspondingly, the drive capability of operational amplifier $\mathbf{17}_{2k-1}$ (or the operational amplifier $\mathbf{17}_{2k}$) is increased in the case that the difference is large between the electrical potential of the data lines $X_{2k-1}$ and $X_{2k}$ when the data lines $X_{2k-1}$ and $X_{2k}$ were short-circuited, and the potential level to which the data line $X_{2k-1}$ should be driven thereafter. Increasing the drive capability is important for reducing the time of duration required for driving the data line $X_{2k-1}$. The data line $X_{2k}$ is driven in the same manner.

In order to achieve the drive capability control, each data driver 3 is provided with the drive capability switching circuit 30 which generates control data for controlling the drive capabilities of the operational amplifiers $\mathbf{17}_1$ to $\mathbf{17}_n$. The operational amplifiers $\mathbf{17}_1$ to $\mathbf{17}_n$ are designed so that that the drive capabilities thereof are variable or controllable in response to the control data received from the drive capability switching circuit 30. A detailed description is given of the drive capability switching circuit 30 and the operational amplifiers $\mathbf{17}_1$ to $\mathbf{17}_n$ in the following.

3. Structure of Drive Capability Switching Circuit and Operational Amplifiers

The drive capability switching circuit 30 includes data processing sections $\mathbf{31}_1$ to $\mathbf{31}_{n/2}$ and control data latches $\mathbf{32}_1$ to $\mathbf{32}_n$. One data processing section $\mathbf{31}_k$ is provided for every two data lines. The control data latches $\mathbf{32}_1$ to $\mathbf{32}_n$ are respectively associated with the operational amplifiers $\mathbf{17}_1$ to $\mathbf{17}_n$. The data processing sections $\mathbf{31}_1$ to $\mathbf{31}_{n/2}$ have a function to generate control data for controlling the drive capabilities of the operational amplifiers $\mathbf{17}_1$ to $\mathbf{17}_n$. The control data latches $\mathbf{32}_1$ to $\mathbf{32}_n$ transfer the generated control data to the operational amplifiers $\mathbf{17}_1$ to $\mathbf{17}_n$.

Figure 4:
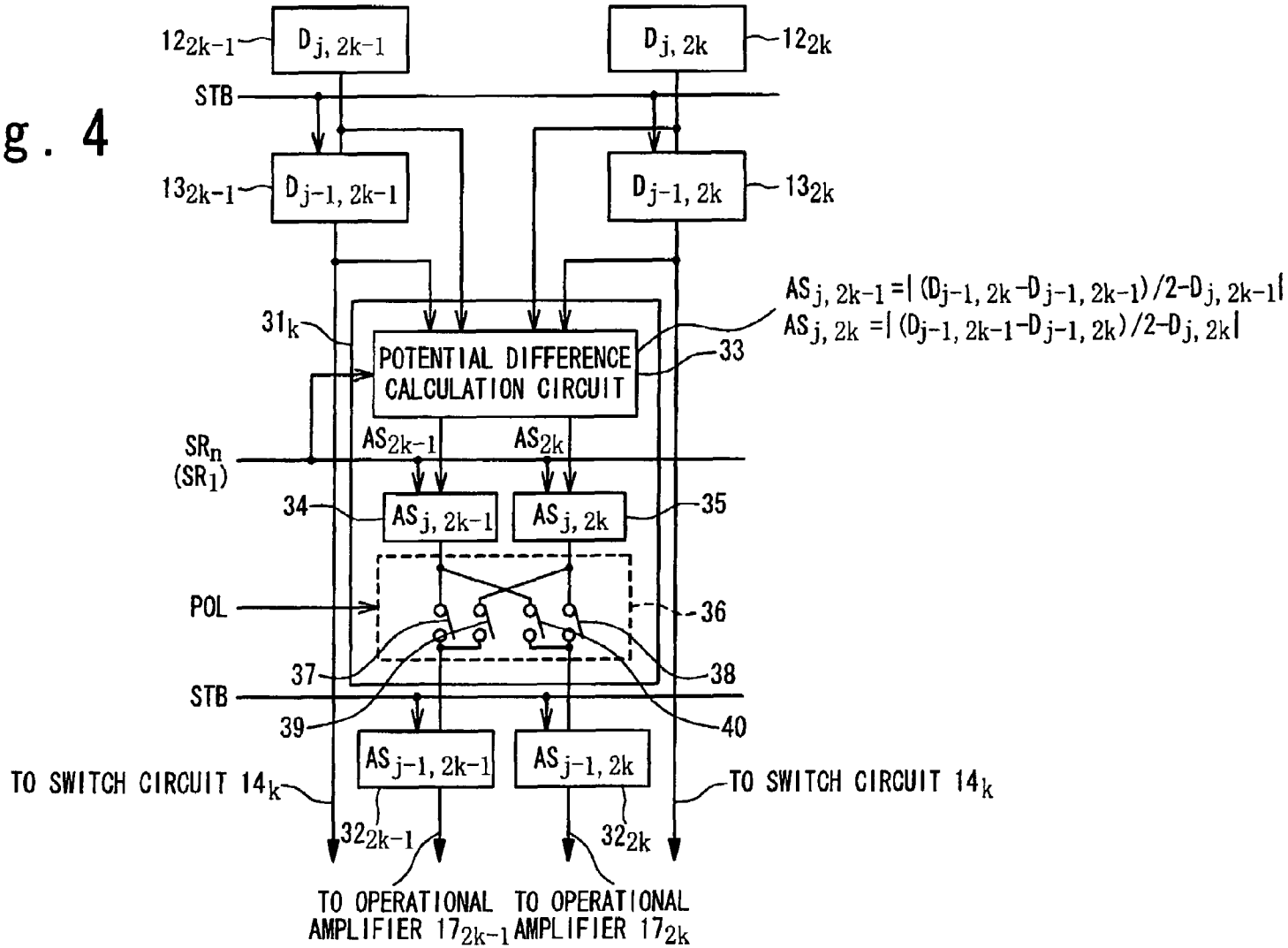
FIG. 4 is a block diagram illustrating a structure of a data processing section within the data driver in the first embodiment.

FIG. 4 is a circuit diagram partially illustrating the structure of the drive capability switching circuit 30, especially illustrating the portion associated with the data processing section $\mathbf{31}_k$ and the control data latches $\mathbf{32}_{2k-1}$ and $\mathbf{32}_{2k}$. The data processing section $\mathbf{31}_k$ generates a pair of control data $AS_{2k-1}$ and $AS_{2k}$ used for controlling the driving capabilities of the operational amplifiers $\mathbf{17}_{2k-1}$ and $\mathbf{17}_{2k}$. The data processing section $\mathbf{31}_k$ sends one of the control data $AS_{2k-1}$ and $AS_{2k}$ to the data control latch $\mathbf{32}_{2k-1}$, and sends the other to the data control latch $\mathbf{32}_{2k}$. The control data latch $\mathbf{32}_{2k-1}$ latches the control data from the data processing section $\mathbf{31}_k$ in response to the latch signal STB, and transfers the latched control data to the operational amplifier $\mathbf{17}_{2k-1}$. Correspondingly, the control data latch $\mathbf{32}_{2k}$ latches the control data from the data processing section $\mathbf{31}_k$ in response to the latch signal STB, and transfers the latched control data to the operational amplifier $\mathbf{17}_{2k}$.

In detail, each data processing section $\mathbf{31}_k$ includes a potential difference calculation circuit 33, control data registers 34 and 35, and a switch circuit 36. The potential difference calculation circuit 33 generates the control data $AS_{2k-1}$ and $AS_{2k}$ in response to the differences between the potential level of the data lines $X_{2k-1}$ and $X_{2k}$ when the data lines $X_{2k-1}$ and $X_{2k}$ are short-circuited during the blanking period of the next horizontal period, and the potential levels to which the data lines $X_{2k-1}$ and $X_{2k}$ are to be driven in the next horizontal period. Specifically, the potential difference calculation circuit 33 receives pixel data of the current horizontal period from the latches $\mathbf{13}_{2k-1}$ and $\mathbf{13}_{2k}$ in the latch circuit 13, and receives pixel data of the next horizontal period from the registers $\mathbf{12}_{2k-1}$ and $\mathbf{12}_{2k}$ in the data register circuit 12. The potential difference calculation circuit 33 then generates the control data $AS_{2k-1}$ and $AS_{2k}$ on the basis of the received pixel data, in order to control the driving capabilities of the operational amplifiers $\mathbf{17}_{2k-1}$ and $\mathbf{17}_{2k}$. More specifically, the control data $AS_{j,2k-1}$ and $AS_{j,2k}$ used for driving the pixels $D_{j,2k-1}$ and $D_{j,2k}$ during the j-th horizontal period are calculated as follows:

$$AS_{j,2k-1}=|(D_{j-1,2k}-D_{j-1,2k-1})/2-D_{j,2k-1}|, \tag{1a}$$

and $$AS_{j,2k}=|(D_{j-1,2k-1}-D_{j-1,2k})/2-D_{j,2k}|. \tag{1b}$$

The control data $AS_{j,2k-1}$ and $AS_{j,2k}$ have values corresponding to the differences between the electrical potential of the data lines $X_{2k-1}$ and $X_{2k}$ when short-circuited in the blanking period of the j-th horizontal period, and the potential levels to which the data lines $X_{2k-1}$ and $X_{2k}$ are respectively driven during the j-th horizontal period. In detail, $(D_{j-1,2k}-D_{j-1,2k-1})/2$ in Formula (1a) represents the potential level of the data lines $X_{2k-1}$ and $X_{2k}$ short-circuited, and $D_{j,2k-1}$ in Formula (1a) represents the potential level to which the data lines $X_{2k-1}$ is to be driven thereafter. Correspondingly, $(D_{j-1,2k-1}-D_{j-1,2k})/2$ in Formula (1b) represents the potential level of the data lines $X_{2k-1}$ and $X_{2k}$ when the data lines $X_{2k-1}$ and $X_{2k}$ are short-circuited, and $D_{j,2k}$ in Formula (1b) represents the potential level to which the data line $X_{2k}$ is to be driven thereafter. As described below, increased drive capabilities are given to the operational amplifiers $\mathbf{17}_{2k-1}$ and $\mathbf{17}_{2k}$ as the increase in the values of the control data $AS_{j,2k-1}$ and $AS_{j,2k}$. Optimization of controlling the drive capabilities of the operational amplifiers $\mathbf{17}_{2k-1}$ and $\mathbf{17}_{2k}$ is thus achieved.

In the strict sense, the potential levels of the data lines are not proportional to the grayscale level values indicated in the pixel data. Instead, the association of the potential levels of the data lines with the grayscale level value indicated in the pixel data is expressed by a curved line so-called "gamma curve". In order to achieve more proper control based on the difference between the potential level of the data lines $X_{2k-1}$ and $X_{2k}$ when short-circuited and the potential levels to which the data lines $X_{2k-1}$ and $X_{2k}$ are driven during the j-th horizontal period, the control data $AS_{j,2k-1}$ and $AS_{j,2k}$ is preferably determined by the following formulae:

$$AS_{j,2k-1}=|\{\gamma(D_{j-1,2k})+\gamma(D_{j-1,2k-1})\}/2-\gamma(D_{j,2k-1})|, \quad (1a)'$$

$$AS_{j,2k}=|\{\gamma(D_{j-1,2k})+\gamma(D_{j-1,2k-1})\}/2-\gamma(D_{j,2k})|, \quad (1b)'$$

where $\gamma(D_{j,i})$ is the potential level associated with the pixel data $D_{j,i}$ in the gamma curve. Although the calculation in accordance with the gamma curve is preferable, it should be also noted that the above-mentioned calculation based on formulae (1a) and (1b) is advantageous for simplicity in implementation.

The control data registers 34 and 35 latch the control data $AS_{2k-1}$ and $AS_{2k}$, respectively, in response to the falling of the trigger pulse signal activated at the latest timing among the trigger pulse signals $SR_1$ to $SR_n$. This operation addresses completing the calculation of the control data $AS_{2k-1}$ and $AS_{2k}$ by the potential difference calculation circuit 33, and the latching of the control data $AS_{2k-1}$ and $AS_{2k}$ into the control data registers 34 and 35 before capturing the pixel data of the next horizontal period stored in the data register circuit 12 into the latches $\mathbf{13}_1$ to $\mathbf{13}_n$ in response to the latch signal STB.

The switch circuit 36 is responsive to the polarity signal POL for switching electrical connections between the control data registers 34 and 35 and the control data latches $\mathbf{32}_{2k-1}$ and $\mathbf{32}_{2k}$. In detail, the switch circuit 36 includes four contact switches: contact switches 37, 38, 39 and 40. The contact switch 37 is connected between the control data register 34 and the control data latch $\mathbf{32}_{2k-1}$, and the contact switch 38 is connected between the control data register 35 and the control data latch $\mathbf{32}_{2k}$. On the other hand, the contact switch 39 is connected between the control data register 34 and the control data latch $\mathbf{32}_{2k}$, and the contact 40 is connected between the control data register 35 and the control data latch $\mathbf{32}_{2k-1}$. The switch circuit 36 thus configured transfers one of the control data $AS_{2k-1}$ and $AS_{2k}$ latched by the control data registers 34 and 35 to the control data latch $\mathbf{32}_{2k-1}$, and transfers the other to the control data latch $\mathbf{32}_{2k}$. The transfer destinations of the control data $AS_{2k-1}$ and $AS_{2k}$ are switched in response to the polarity signal POL. The necessity of the switch circuit 36 is based on the fact that the transfer destinations of the pixel data stored in the latches $\mathbf{13}_{2k-1}$ and $\mathbf{13}_{2k}$ of the latch circuit 13 are switched by the switch circuit $\mathbf{14}_k$. When the pixel data $D_{j,2k-1}$ are transferred to the selector $\mathbf{16}_{2k}$ and the operational amplifier $\mathbf{17}_{2k}$ is driven in response to the pixel data $D_{j,2k-1}$, for example, the control data $AS_{2k-1}$ associated with the pixel data $D_{j,2k-1}$ is required to be transferred to the operational amplifier $\mathbf{17}_{2k}$ through the control data latch $\mathbf{32}_{2k}$.

The control data transferred to the control data latch $\mathbf{32}_{2k-1}$ is further transferred to the operational amplifier $\mathbf{17}_{2k-1}$ for controlling the drive capability of the operational amplifier $\mathbf{17}_{2k-1}$. Correspondingly, the control data transferred to the control data latch $\mathbf{32}_{2k}$ is further transferred to the operational amplifier $\mathbf{17}_{2k}$ for controlling the drive capability of the operational amplifier $\mathbf{17}_{2k}$.

The drive capability of the operational amplifiers $\mathbf{17}_1$ to $\mathbf{17}_n$ is increased as the increase in the values of the control data transferred thereto, to thereby configure the respective operational amplifiers $\mathbf{17}_1$ to $\mathbf{17}_n$ with appropriate drive capabilities depending on the differences between the potential levels of the corresponding pairs of the adjacent data lines when short-circuited and the potential levels to which the respective data lines are driven thereafter. When the operational amplifier $\mathbf{17}_{2k-1}$ is driven in response to the pixel data $D_{j,2k-1}$ during the j-th horizontal period, for example, the control data $AS_{j,2k-1}$ fed to the operational amplifier $\mathbf{17}_{2k-1}$ is increased as the increase in the difference between the potential level of the data lines $X_{2k-1}$ and $X_{2k}$ when the data lines $X_{2k-1}$ and $X_{2k}$ are short-circuited during the blanking period and the potential level to which the data line $X_{2k-1}$ is driven thereafter, and vice versa. The drive capability of the operational amplifier $\mathbf{17}_{2k-1}$ is increased in accordance with the increase of the control data $AS_{j,2k-1}$ to achieve the optimization of the drive capability of the operational amplifiers $\mathbf{17}_{2k-1}$.

Figure 5A:
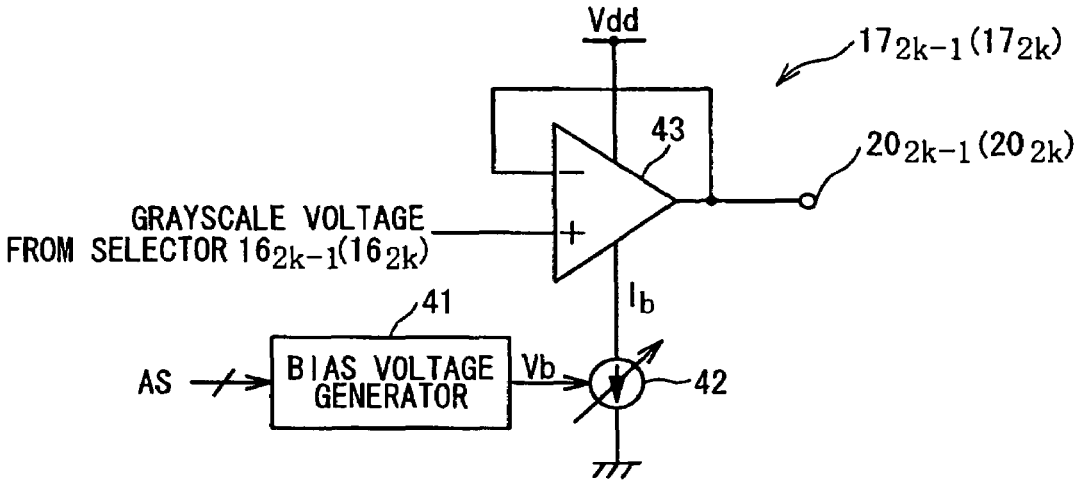
FIG. 5A is a schematic circuit diagram illustrating a preferred structure of operational amplifiers within the data driver in the first embodiment.

FIG. 5A is a circuit diagram illustrating an exemplary structure of the operational amplifiers $\mathbf{17}_1$ to $\mathbf{17}_n$ adapted to the above-described operation. Each operation amplifier $\mathbf{17}_{2k-1}$ ($\mathbf{17}_{2k}$) includes a bias voltage generating circuit 41, a current source 42 and a voltage follower 43. The bias voltage generating circuit 41 generates a bias voltage Vb in response to the control data AS received from the control data latches $\mathbf{32}_{2k-1}$ (or $\mathbf{32}_{2k}$). The generation of the bias voltage Vb is increased in accordance with the increase of the control data AS. The current source 42 is responsive to the bias voltage Vb for feeding a bias current Ib to the voltage follower 43. The bias current Ib is increased as the increase in the bias voltage Vb. The voltage follower 43 receives the bias current Ib to drive the output terminal $\mathbf{20}_{2k-1}$ (or $\mathbf{20}_{2k}$), that is, the data line $X_{2k-1}$ (or $X_{2k}$), to the potential level corresponding to the grayscale voltage received from the selector $\mathbf{16}_{2k-1}$ (or $\mathbf{16}_{2k}$). The voltage follower 43 incorporates a differential amplifier and an output stage (not shown), which operate on the bias current Ib. Accordingly, the drive capability of the voltage follower 43 is increased as the increase in the bias current Ib. In the operational amplifier $\mathbf{17}_{2k-1}$ ($\mathbf{17}_{2k}$) thus configured, the increase of the control data AS increases the bias current Ib, and thereby increases the drive capability of the operational amplifier $\mathbf{17}_{2k-1}$ ($\mathbf{17}_{2k}$).

Figure 5B:
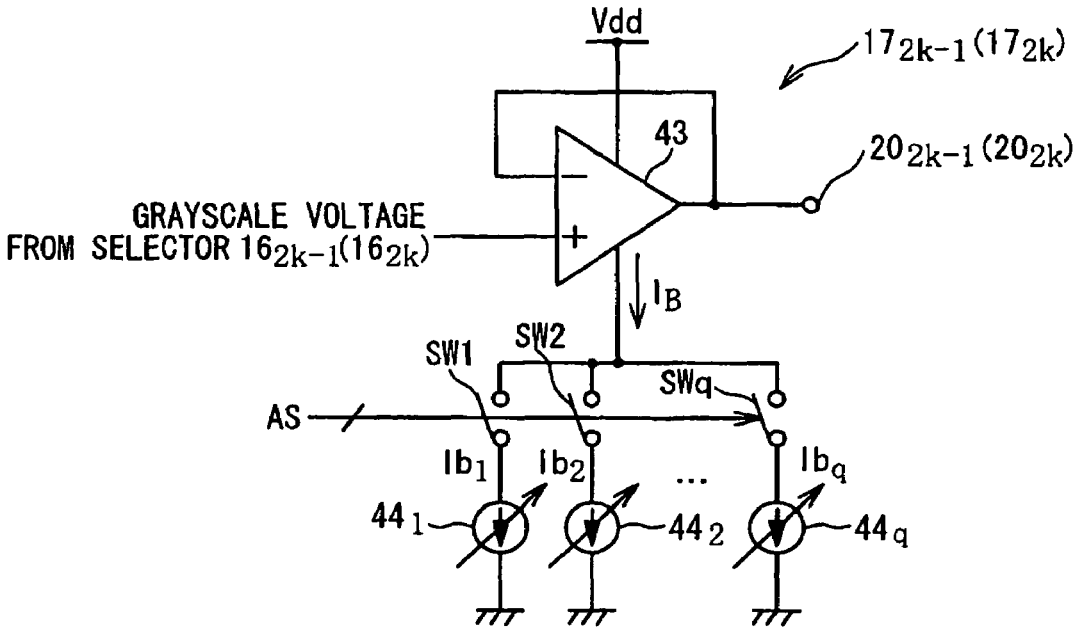
FIG. 5B is a schematic circuit diagram illustrating another preferred structure of operational amplifiers within the data driver in the first embodiment.

FIG. 5B is a circuit diagram illustrating another exemplary structure of the operational amplifiers $\mathbf{17}_1$ to $\mathbf{17}_n$. In the operational amplifiers in FIG. 5B, a plurality of switches SW1 to SWq and constant current sources $\mathbf{44}_1$ to $\mathbf{44}_q$ generating currents of the same intensity are provided in replace of the bias voltage generating circuit 41 and the current source 42. The switch $SW_i$ and the constant current source $\mathbf{44}_i$ are connected in series between the voltage follower 43 and a ground terminal. Selected one(s) out of the switches SW1 to SWq is turned on in response to the control data AS, the number of the switches turned on being determined in response to the value of the control data AS. The voltage follower 43 is fed with the bias current Ib having the intensity proportional to the number of the switches SW that are turned on. Accordingly, in the structure shown in FIG. 5B, the bias current Ib is also increased as the increase in the control data AS, and consequently the drive capability of the operational amplifier $\mathbf{17}_{2k-1}$ ($\mathbf{17}_{2k}$) is increased.

4. Operation of Data Driver

Figure 6:
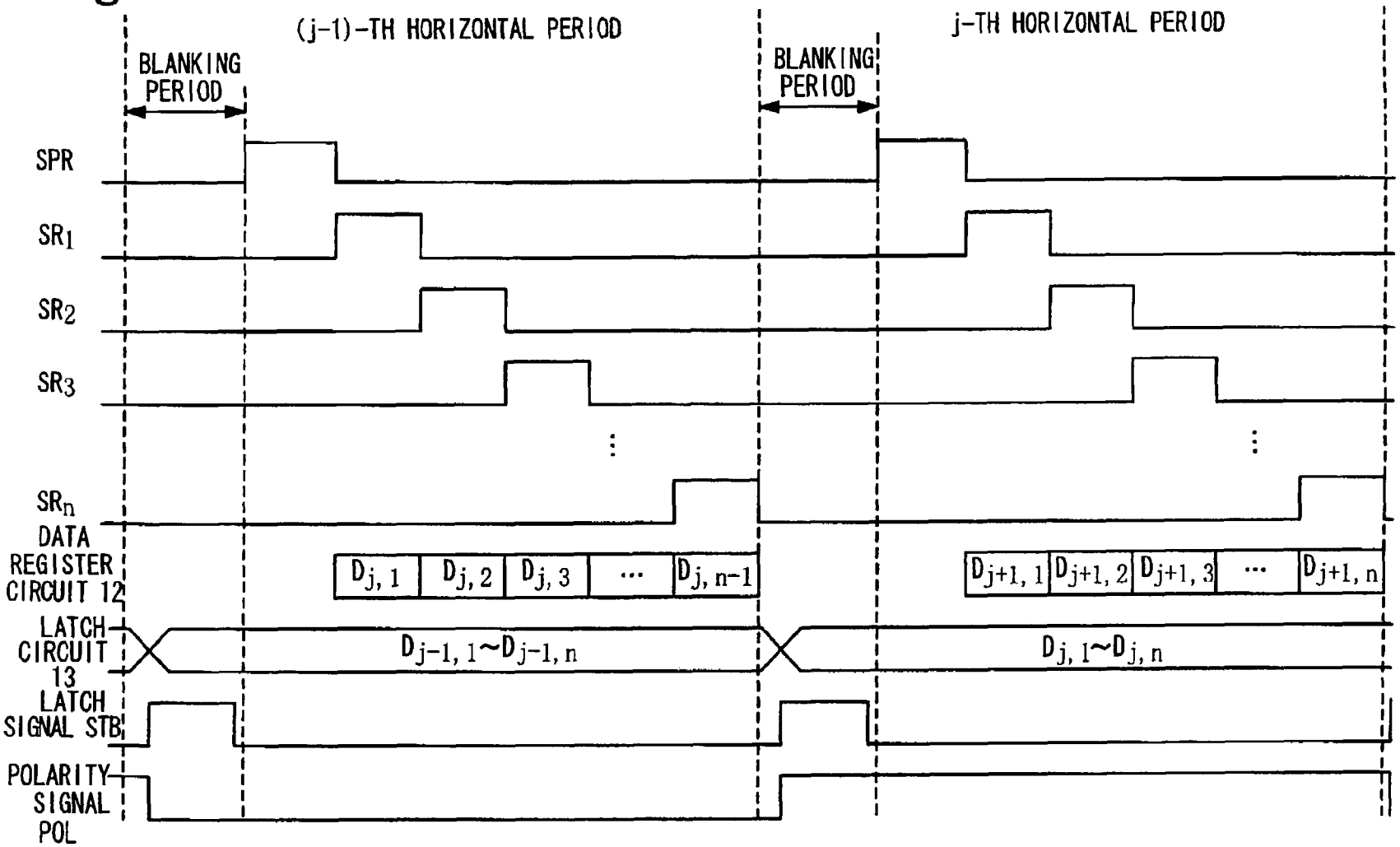
FIG. 6 is a timing chart illustrating an operation of the data driver in the first embodiment.

A detailed explanation will be given of an exemplary operation of the data driver 3 in the following, in particular of a procedure of generating control data used for the control of the operational amplifiers $\mathbf{17}_1$ to $\mathbf{17}_n$ in the j-th horizontal period and a procedure of controlling the drive capabilities on the basis of the control data. FIG. 6 is a timing chart illustrating the operation of the data driver 3 during a (j−1)-th horizontal period (i.e. a period in which pixels in the (j−1)-th line are driven) and the j-th horizontal period.

Control data used in the j-th horizontal period for controlling the drive capabilities of the operational amplifiers $\mathbf{17}_1$ to $\mathbf{17}_n$ are generated in the (j−1)-th horizontal period. Such generating procedure of the control data is preferable for the prompt control of the drive capabilities of the operational amplifiers $\mathbf{17}_1$ to $\mathbf{17}_n$ in the j-th horizontal period; it is not preferable to generate the control data used in the j-th horizontal period in the current j-th horizontal period, since it may cause undesirable delay for the operational amplifiers $\mathbf{17}_1$ to $\mathbf{17}_n$ to start outputting the data signals in the j-th horizontal period.

In detail, when the latch signal STB is activated in the blanking period within the (j−1)-th horizontal period, every adjacent two data lines are short-circuited by the short-circuit switches $\mathbf{21}_1$ to $\mathbf{21}_n$. Further, in response to the activation of the latch signal STB, pixel data $D_{j-1,1}$ to $D_{j-1,n}$ used for generating data signals in the (j−1)-th horizontal period are transferred from the data register circuit 12 to the latch circuit 13. The data lines $X_1$ to $X_n$ are driven during the (j−1)-th horizontal period in response to the pixel data $D_{j-1,1}$ to $D_{j-1,n}$ that are transferred to the latch circuit 13. The polarities of the data signals fed to the respective data lines are determined by the polarity signal POL. In this embodiment, in response to the polarity signal POL being set to the "H" level, data signals of the positive polarity are fed to the odd-numbered data lines $X_1, X_3, \ldots$, and data signals of the negative polarity are fed to the even-numbered data lines $X_2, X_4, \ldots$.

While the data lines $X_1$ to $X_n$ are driven during the (j−1)-th horizontal period, pixel data used for driving the data lines $X_1$ to $X_n$ in the j-th horizontal period are transferred to the data register circuit 12 from the LCD controller 2. More specifically, in response to the activation of the start pulse signal SPR, the trigger pulse signals $SR_1$ to $SR_n$ are sequentially activated, and then the pixel data $D_{j,1}$ to $D_{j,n}$ are sequentially transferred in synchronization of the sequential activations of the trigger pulse signals $SR_1$ to $SR_n$. This results in that the registers $\mathbf{12}_1$ to $\mathbf{12}_n$ store the pixel data $D_{j,1}$ to $D_{j,n}$ within the data register circuit 12.

After the pixel data $D_{j,1}$ to $D_{j,n}$ are stored in the registers $\mathbf{12}_1$ to $\mathbf{12}_n$, the data processing sections $\mathbf{31}_1$ to $\mathbf{31}_n$ within the drive capability switching circuit 30 calculate control data used in the j-th horizontal period. In detail, as shown in FIG. 7, the potential difference calculation circuit 33 in the data processing section $\mathbf{31}_k$ calculates the control data $AS_{j,2k-1}$ and $AS_{j,2k}$ from the pixel data $D_{j,2k-1}$ and $D_{j,2k-1}$ stored in the registers $\mathbf{12}_{2k-1}$ and $\mathbf{12}_{2k}$, and from the pixel data $D_{j-1,2k-1}$ and $D_{j-1,2k-1}$ stored in the latches $\mathbf{13}_{2-k}$ and $\mathbf{13}_{2k}$, on the basis of Formulae (1a) and (1b) above-described.

The calculated control data are latched to the control data registers 34 and 35 in the data processing sections $\mathbf{31}_1$ to $\mathbf{31}_n$ at the end of the (j−1)-th horizontal period. Specifically, in response to the falling of the trigger pulse $SR_n$, which is activated at the latest timing among the trigger pulses $SR_1$ to $SR_n$, the control data $AS_{j,2k-1}$ is latched into the data register 34 in the data processing section $\mathbf{31}_k$, and the control data $AS_{j,2k}$ is latched into the control data register 35.

When the j-th horizontal period is started, as shown in FIG. 6, the polarity signal POL is inverted in the blanking period, and then the latch signal STB is activated. In response to the activation of the latch signal STB, ever two adjacent data lines are short-circuited by the short-circuit switches $\mathbf{21}_1$ to $\mathbf{21}_n$. In detail, the data lines $X_{2k-1}$ and $X_{2k}$ are short-circuited by the short-circuit switch $\mathbf{21}_k$. The potential level of the data lines $X_{2k-1}$ and $X_{2k}$ after the short-circuit is the average of potential levels to which the data lines $X_{2k-1}$ and $X_{2k}$ are driven in the previous (j−1)-th horizontal period.

Figure 7:
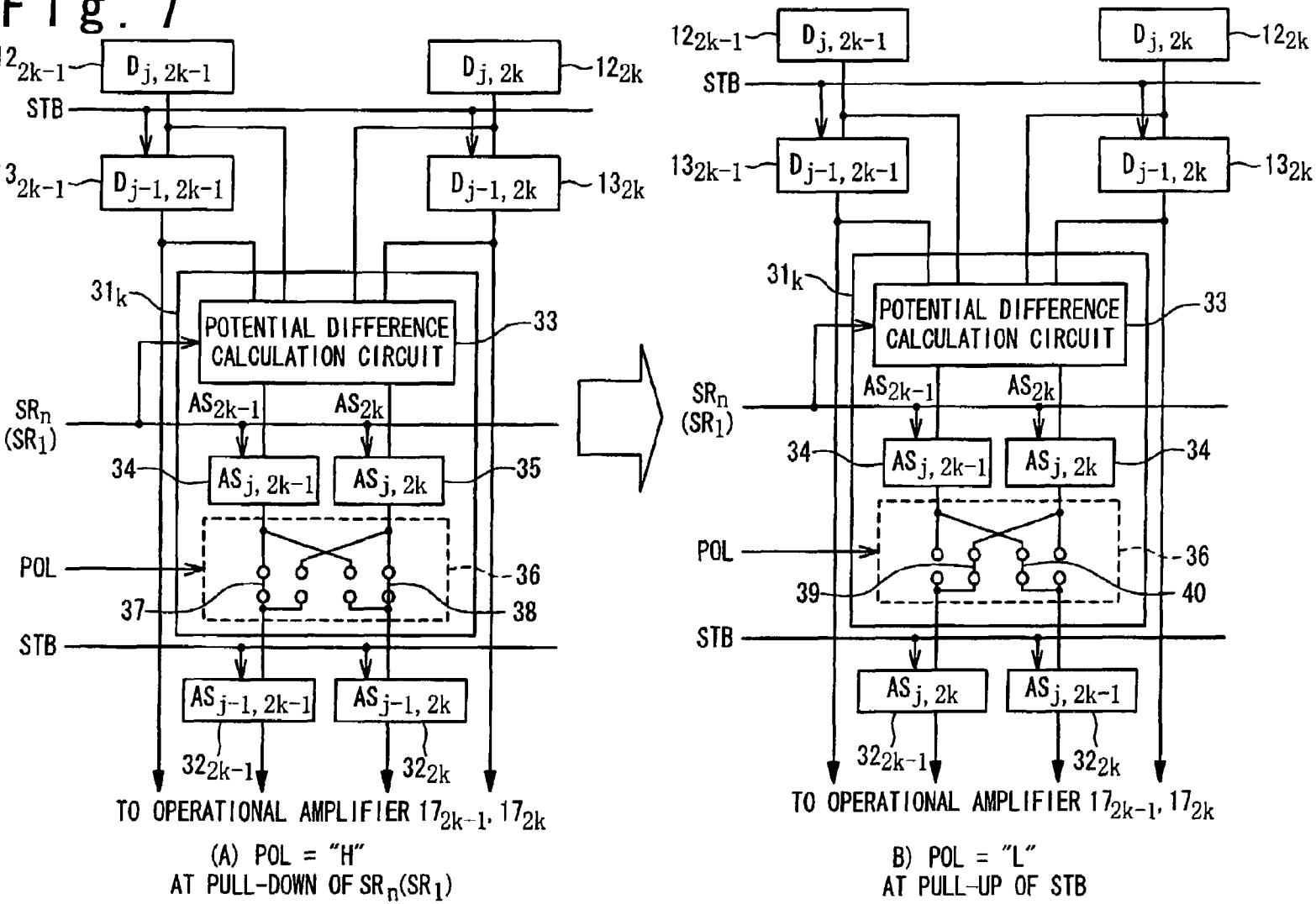
FIG. 7 is a schematic diagram illustrating an operation of the data processing section and a control data latch within the data driver in the first embodiment.

Moreover, as shown in FIG. 7, the control data stored in the control data registers 34 and 34 within the data processing section $\mathbf{31}_1$ to $\mathbf{31}_n$ are transferred to the operational amplifiers $\mathbf{17}_1$ to $\mathbf{17}_n$ through the control data latches $\mathbf{32}_1$ to $\mathbf{32}_n$. In detail, when the latch signal STB is activated in the blanking period of the j-th horizontal period, the control data $AS_{j,2k-1}$ stored in the control data register 34 within the data processing section $\mathbf{31}_k$ is transferred to selected one of the control data latches $\mathbf{32}_{2k-1}$ and $\mathbf{32}_{2k}$, and the control data $AS_{j,2k}$ stored in the control data register 35 within the data processing section $\mathbf{31}_k$ is transferred to the other of the control data latches $\mathbf{32}_{2k-1}$ and $\mathbf{32}_{2k}$.

Figure 8:
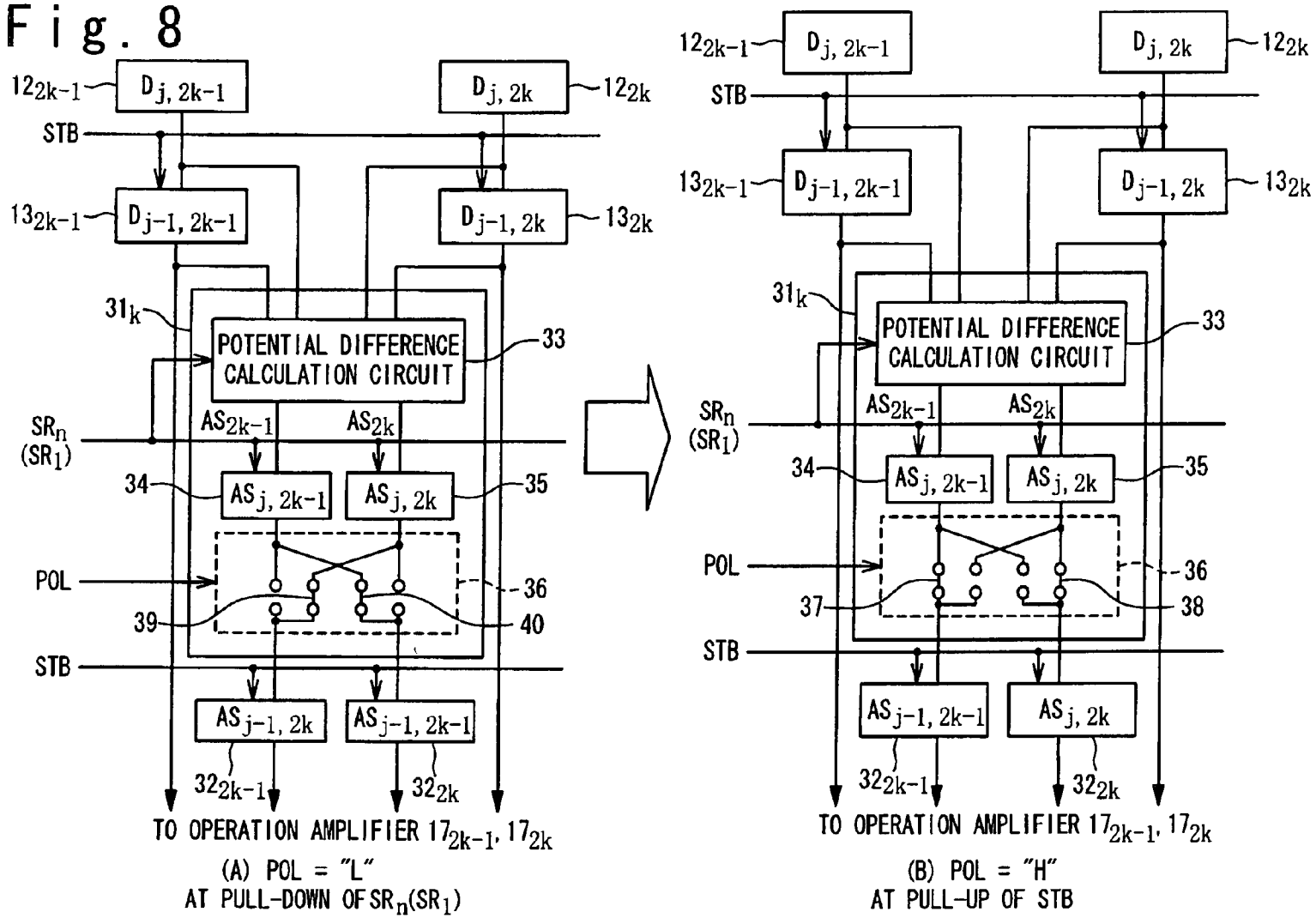
FIG. 8 is a schematic diagram illustrating an operation of the data processing section and the control data latch of the data driver in the first embodiment.

The transfer destinations of the control data are switched in accordance with the polarity signal POL. In this embodiment, as shown in FIG. 7, the control data $AS_{j,2k-1}$ stored in the control data register 34 within the data processing section $\mathbf{31}_k$ is transferred to the control data latch $\mathbf{32}_{2k}$, and the control data $AS_{j,2k}$ stored in the control data register 35 is transferred to the control data latch $\mathbf{32}_{2k-1}$, in response to the polarity signal POL being set to the "L" level. As shown in FIG. 8, it goes vice versa when the polarity signal POL is set to the "H" level. Switching the transfer destinations of the control data in accordance with the polarity signal POL is to provide the operational amplifiers with appropriate control data associated with the transfer destinations of the pixel data. In the operation shown in FIG. 7, the control data $AS_{j,2k-1}$ is transferred to the operational amplifier $\mathbf{17}_{2k}$ in accordance with tha fact that the operational amplifier $\mathbf{17}_{2k}$ is driven in response to the pixel data $D_{j,2k-1}$.

The operational amplifiers $\mathbf{17}_1$ to $\mathbf{17}_n$ are configured with drive capabilities corresponding to the transferred control data. In the operation shown in FIG. 7, the operational amplifier $\mathbf{17}_{2k-1}$ is fed with the control data $AS_{j,2k}$, and the drive capability of the operational amplifier $\mathbf{17}_{2k-1}$ is controlled in accordance with the control data $AS_{j,2k}$. Correspondingly, the operational amplifier $\mathbf{17}_{2k}$ is fed with the control data $AS_{j,2k-1}$, and the drive capability of the operational amplifier $\mathbf{17}_{2k}$ is controlled in accordance with the control data $AS_{j,2k-1}$. This achieves optimization in the drive capability control of the operational amplifiers $\mathbf{17}_{2k-1}$ and $\mathbf{17}_{2k}$, and thus thereby effectively reduces power consumption of the data driver 3.

Figure 9:
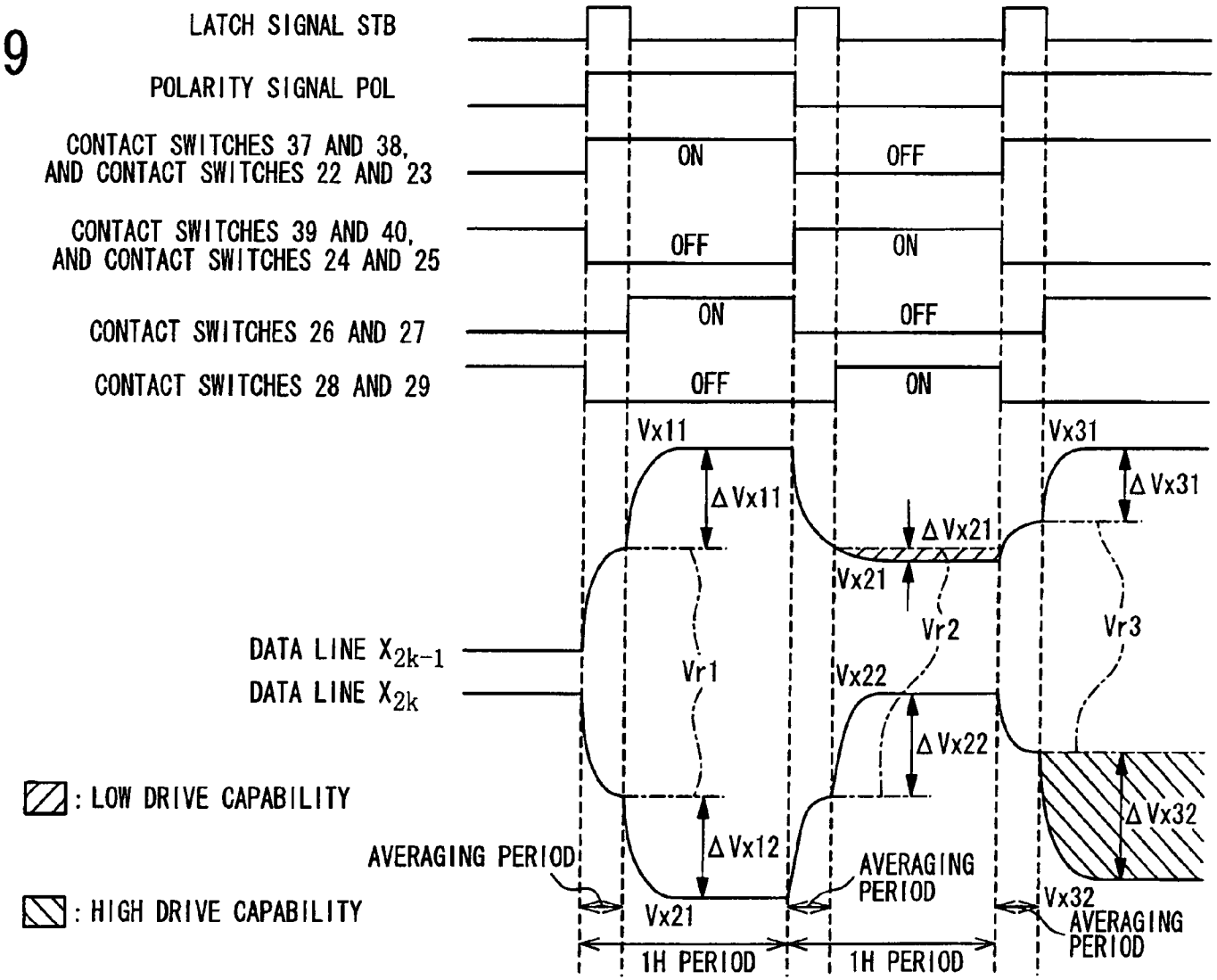
FIG. 9 is a timing chart illustrating an exemplary operation of the data driver in the first embodiment.

FIG. 9 is a timing chart showing an example of the operation of the data driver 3. In this example, it is assumed that the data line $X_{2k-1}$ is driven to a positive potential level $V_{x11}$ and the data line $X_{2k}$ is driven to a negative potential level $V_{x21}$ in the j−1-th horizontal period. When the data lines $X_{2k-1}$ and $X_{2k}$ are short-circuited in the blanking period of the following j-th horizontal period, the potential level of the data lines $X_{2k-1}$ and $X_{2k}$ is set to the average level $V_{r2}[=(V_{x11}+V_{x21})/2]$. Thereafter, in the j-th horizontal period, the data line $X_{2k-1}$ is driven to the negative potential level $V_{x21}$ and the data line $X_{2k}$ is driven to the positive potential level $V_{x22}$. In accordance with the small difference $\Delta V_{x21}$ between the average level $V_{r2}$ and the potential level $V_{x21}$, the operational amplifier $\mathbf{17}_{2k-1}$ that drives the data line $X_{2k-1}$ is set to have a low drive capability, as indicated by the diagonal hatching (lower left to upper right) in FIG. 9. The operational amplifiers are configured with a low drive capability if high drive capability is not needed, and thereby the static current consumption, i.e. power consumption in the amplifier is reduced.

When the data lines $X_{2k-1}$ and $X_{2k}$ are short-circuited in the blanking period of the next (j+1)-th horizontal period, the potential level of the data lines $X_{2k-1}$ and $X_{2k}$ is transitioned to the average level $V_{r3}[=(V_{x21}+V_{x22})/2]$. Thereafter, in the (j+1)-th horizontal period, the data line $X_{2k-1}$ is driven to a positive potential level $V_{x31}$ and the data line $X_{2k}$ is driven to a negative potential level $V_{x32}$. In response to the large difference $\Delta V_{x32}$ between the average level $V_{r3}$ and the potential level $V_{x32}$, the operational amplifier driving the data line $X_{2k}$ is configured with a high drive capability, as indicated by the diagonal hatching (upper left to lower right) in FIG. 9. The operational amplifiers are configured with a high drive capability if needed, which will result in a prompt driving of the data lines.

Second Embodiment

Figure 10:
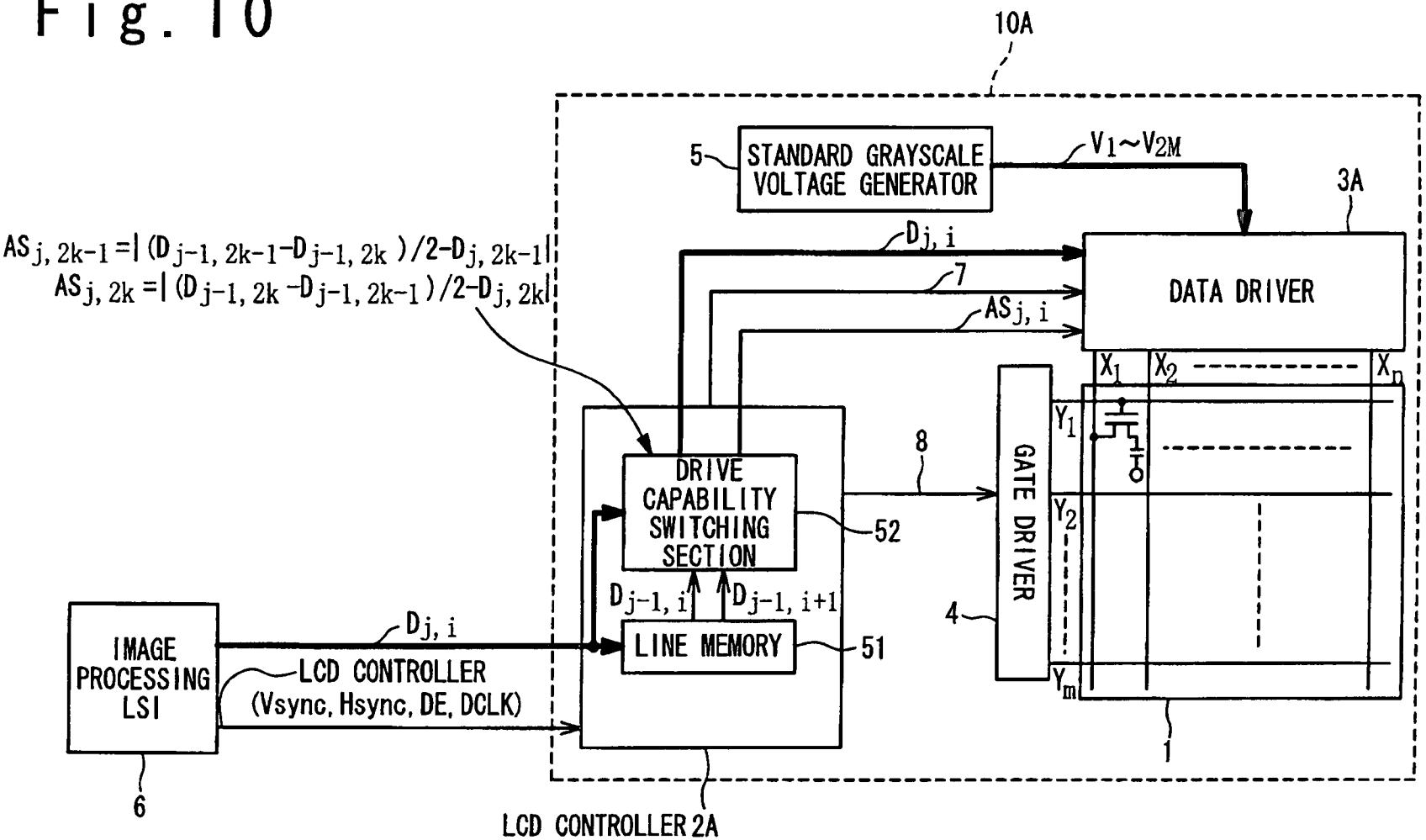
FIG. 10 is a block diagram illustrating a structure of a data driver of a liquid crystal display device in a second embodiment of the present invention.

FIG. 10 is a block diagram showing an exemplary structure of a liquid crystal display device 10A in a second embodiment of the present invention. The main difference between the liquid crystal display device 10A in this embodiment and the liquid crystal display device 10 in the first embodiment is that the generation of the control data AS is implemented by an LCD controller 2A instead of the data driver 3A.

More specifically, the LCA controller 2A includes a line memory 51 having a capacity for pixel data of pixels in one line, and a drive capability switching section 52 which generates the control data AS used for controlling the drive capability of the operational amplifier $\mathbf{17}_1$ to $\mathbf{17}_n$. The line memory 51 stores the pixel data $D_{j-1,1}$ to $D_{j-1,n}$ associated with the pixels in the (j−1)-th line, when the control data $AS_{j,1}$ to $AS_{j,n}$ are calculated, which are used for driving the pixel $P_{j,1}$ to $P_{j,n}$ in the j-th horizontal period. When the pixel data $D_{j,1}$ to $D_{j,n}$ of the j-th line pixel are provided to the LCD controller 2A from the image processing LSI 6, the drive capability switching section 52 generates the control data $AS_{j,1}$ to $AS_{j,n}$ from the pixel data $D_{j,1}$ to $D_{j,n}$ and the pixel data $D_{j-1,1}$ to $D_{j-1,n}$ stored in the line memory 51. The control data $AS_{j-1,n}$ to $AS_{j,n}$ are calculated on the basis of Formulae (1a) and (1b) above-described. The generated control data $AS_{j,1}$ to $AS_{j,n}$ are transferred to the data driver 3A. The transfer of the control data $AS_{j,1}$ to $AS_{j,n}$ is carried out in synchronization of the transfer of the pixel data $D_{j,1}$ to $D_{j,n}$ to the data driver 3.

In accordance with the fact that the line memory 51 is provided within the LCD controller 2A and the generation of the control data AS is implemented by the LCD controller 2A, the structure of the data driver 3A is changed from that of the data driver 3 in the first embodiment as follows.

Figure 11:
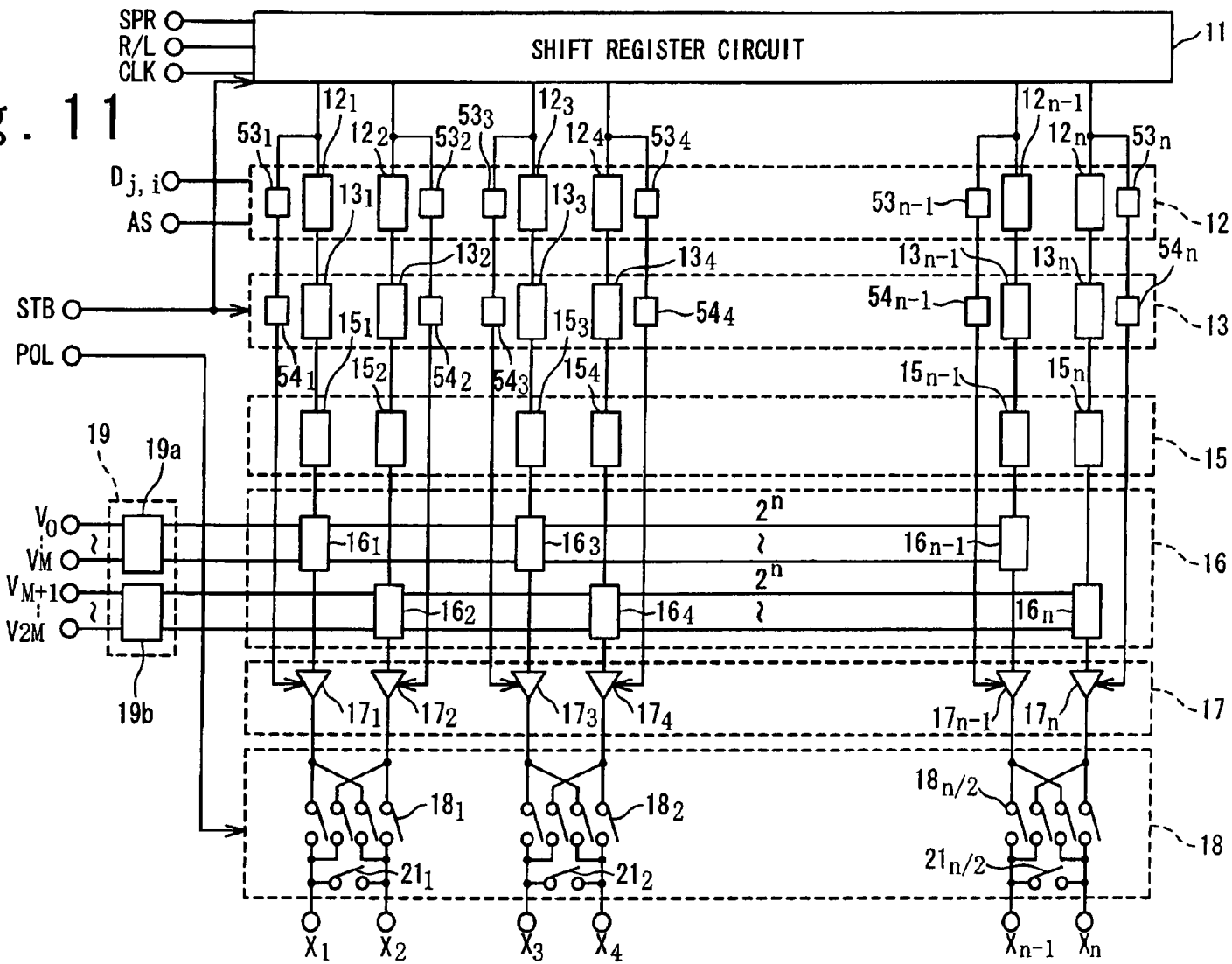
FIG. 11 is a block diagram illustrating a structure of the data driver of the liquid crystal display device in the second embodiment.
Figure 12:
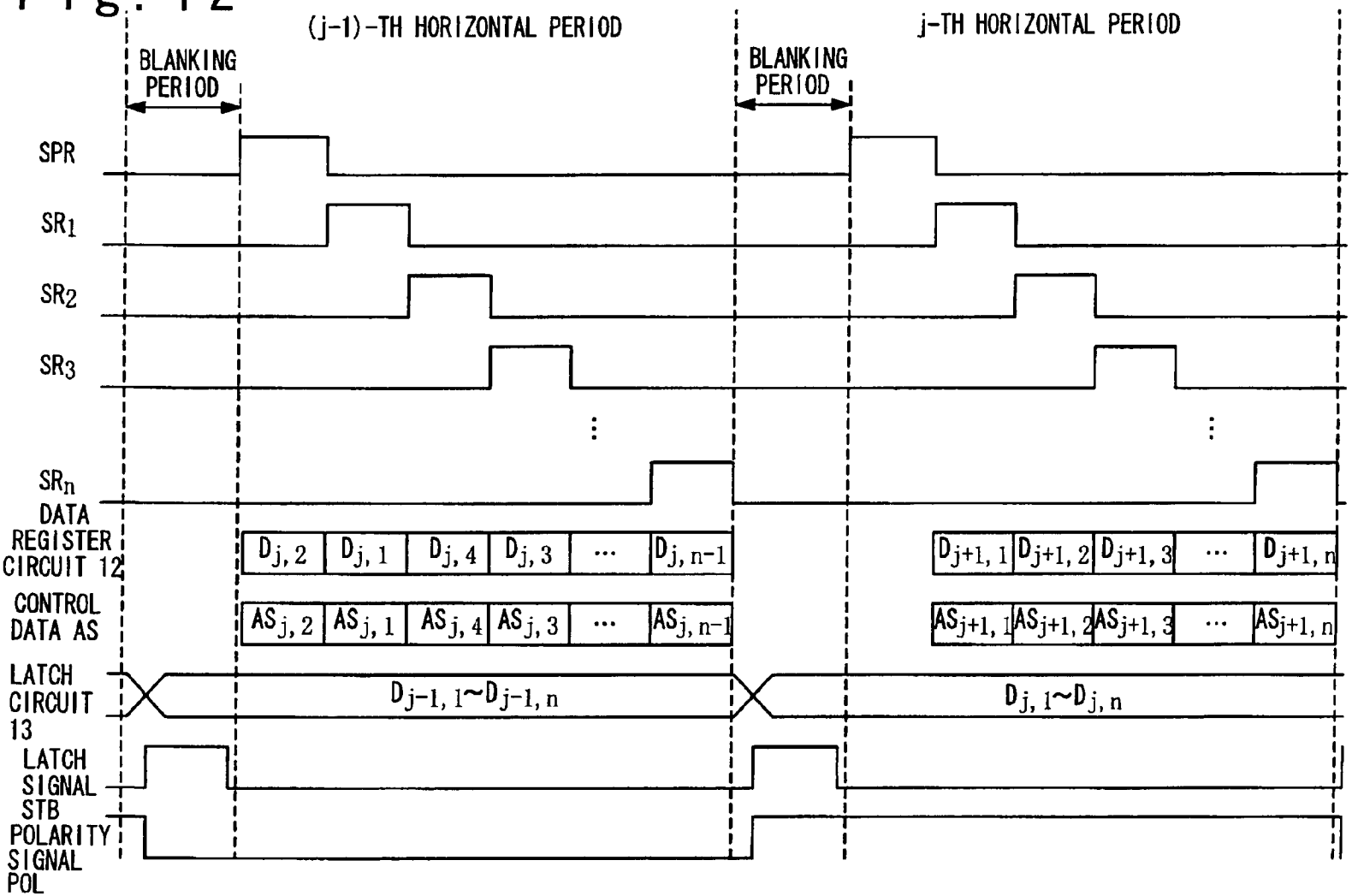
FIG. 12 is a timing chart illustrating an operation of the data driver in the second embodiment.

As shown in FIG. 11, the input-side switch circuitry 14 is removed from the data driver 3A. Instead, the line memory 51 provided in the present embodiment is utilized to switch the order of transferring the pixel data to the data driver 3A in response to the polarity signal POL. More specifically, as shown in FIG. 12, the order of transferring the pixel data $D_{j,1}$ to $D_{j,n}$ of the j-th line pixel is switched when the polarity signal POL is set to the "L" level so that the pixel data are transferred to the data driver 3A in the order of $D_{j,2}$, $D_{j,1}$, $D_{j,4}$, $D_{j,3}$ . . . . On the other hand, the order of the pixel data transfer is not switched when the polarity signal POL is set to the "H" level; the pixel data are transferred to the data driver 3A in the order of $D_{j,1}$, $D_{j,2}$, . . . . This achieves an operation equivalent to the operation of the data driver 3 shown in FIG. 2, which incorporates the input-side switch circuitry 14. The structure of the data driver 3A shown in FIG. 11, which excludes the input-side switch circuitry 14, is preferable for simplifying the structure of the data driver 3A.

In addition, as shown in FIG. 11, the data driver 3A additionally includes control data registers $\mathbf{53}_1$ to $\mathbf{53}_n$ and control data latches $\mathbf{54}_1$ to $\mathbf{54}_n$. These registers and lathes are provided to transfer the control data AS received from the LCD controller 2A to the operational amplifiers $\mathbf{17}_1$ to $\mathbf{17}_n$ at an appropriate timing. The control data registers $\mathbf{53}_1$ to $\mathbf{53}_n$ receive the control data AS from the LCD controller 2A in response to the trigger pulse signals $SR_1$ to $SR_n$. The control data latches $\mathbf{54}_1$ to $\mathbf{54}_n$ latch the control data AS from the control data registers $\mathbf{53}_1$ to $\mathbf{53}_n$ in response to the latch signal STB, and transfer the latched control data AS to the operational amplifiers $\mathbf{17}_1$ to $\mathbf{17}_n$. Similarly to the data register circuit 12, the control data registers $\mathbf{53}_1$ to $\mathbf{53}_n$ are used to store the control data AS used in the next horizontal period, while the control data latches $\mathbf{54}_1$ to $\mathbf{54}_n$ are used to store the control data used in the current horizontal period.

The control data are transferred from the control data latches $\mathbf{54}_1$ to $\mathbf{54}_n$ to the operational amplifiers $\mathbf{17}_1$ to $\mathbf{17}_n$, and the drive capabilities of the operational amplifiers $\mathbf{17}_1$ to $\mathbf{17}_n$ are controlled in accordance with the transferred control data. As is the case of the first embodiment, the drive capability control of the operational amplifiers $\mathbf{17}_1$ to $\mathbf{17}_n$ effectively reduces power consumption of the data driver 3A.

Third Embodiment

Figure 13:
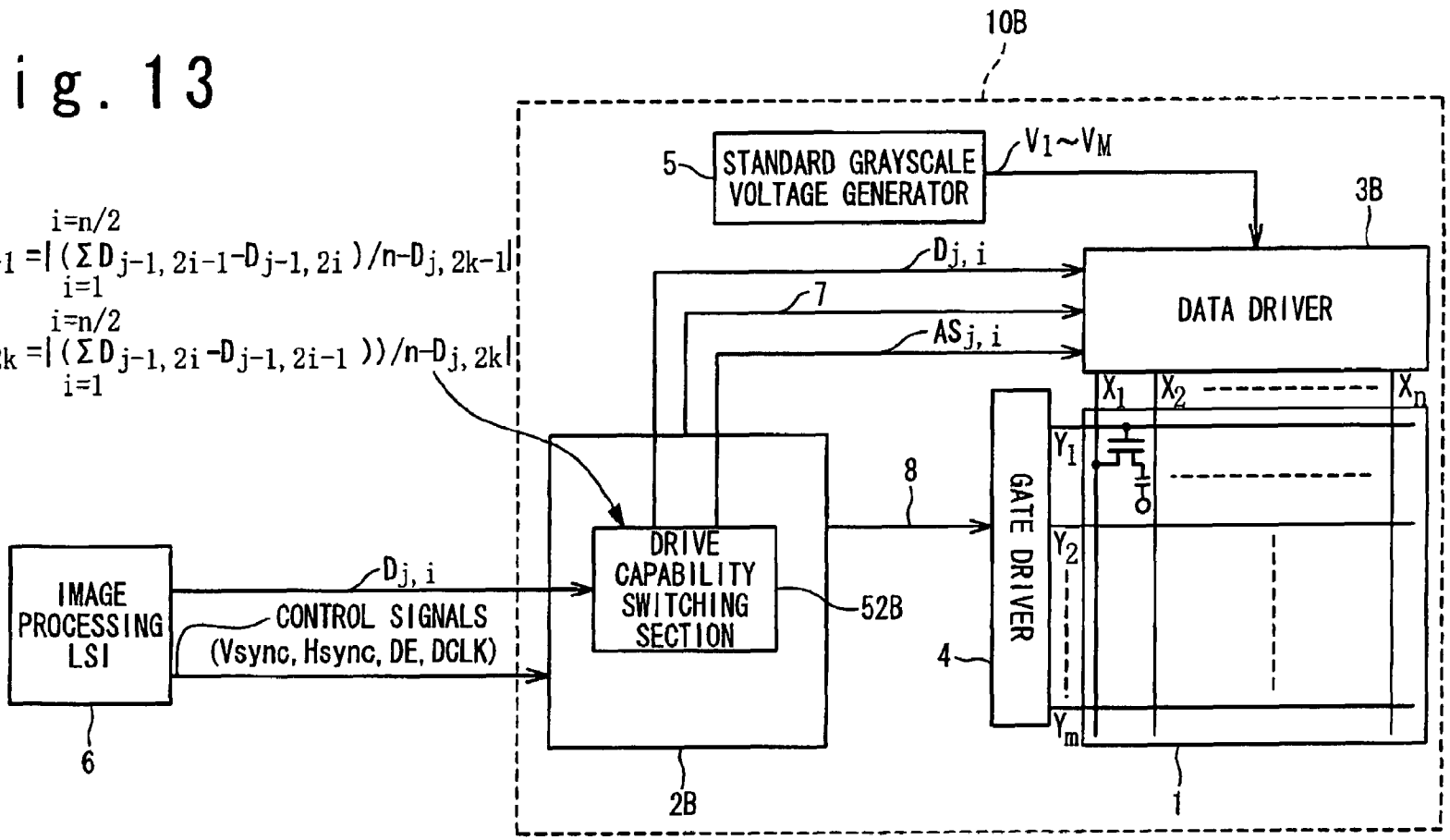
FIG. 13 is a block diagram illustrating a structure of a data driver of a liquid crystal display device in a third embodiment.
Figure 14:
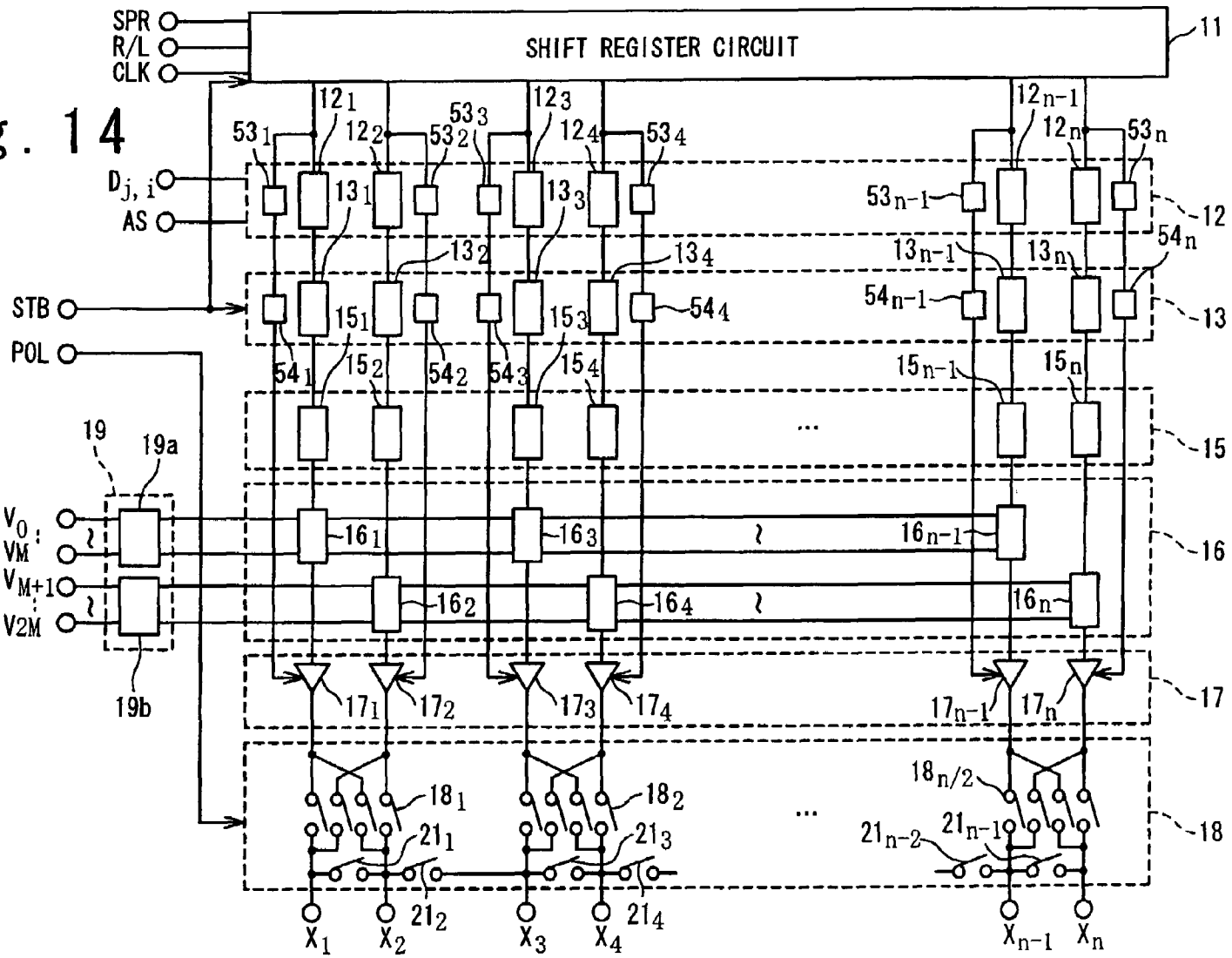
FIG. 14 is a block diagram illustrating a structure of the data driver in the third embodiment.

Referring to FIG. 13, a data driver 3B is configured in a third embodiment, so that all the data lines $X_1$ to $X_n$ are short-circuited during the blanking periods of the respective horizontal periods. More specifically, as shown in FIG. 14, (n−1) short-circuit switches $\mathbf{21}_1$ to $\mathbf{21}_{(n-1)}$ are connected between any adjacent data lines $X_1$ to $X_n$. The short-circuit switches $\mathbf{21}_1$ to $\mathbf{21}_{(n-1)}$ are turned on in the blanking periods of the respective horizontal periods, and the data lines $X_1$ to $X_n$ are thus short-circuited to have an identical potential level.

Accordingly, the calculation method of the control data AS is modified so that the drive capabilities of the operational amplifiers $\mathbf{17}_1$ to $\mathbf{17}_n$ are controlled in response to the potential level of the data lines $X_1$ to $X_n$ when the data lines $X_1$ to $X_n$ are short-circuited. More specifically, the drive capability switching section 52B within the LCD controller 2B calculates the control data $AS_{j,1}$ to $AS_{j,n}$ used in the j-th horizontal period according to formulae below:

$$AS_{j,2k-1} = \left| \sum_{i=1}^{i=n/2} (D_{j-1,2i} - D_{j-1,2i-1})/n - D_{j,2k-1} \right|, \tag{2a}$$

$$AS_{j,2k} = \left| \sum_{i=1}^{i=n/2} (D_{j-1,2i-1} - D_{j-1,2i})/n - D_{j,2k} \right|, \tag{2a}$$

The first term of Formula (2a) corresponds to the potential level of the data line $X_1$ to $X_n$ when the data line $X_1$ to $X_n$ are short-circuited, and the second term ($D_{1,2k-1}$) of Formula (2a) corresponds to the potential level to which the data line $X_{2k-1}$ is driven thereafter. The same applies to Formula (2b).

The calculated control data $AS_{j,1}$ to $AS_{j,n}$ are transferred to the data driver 3B in synchronization of the transfer of the pixel data $D_{j,1}$ to $D_{j,n}$. The data driver 3B controls the drive capabilities of the operational amplifiers $\mathbf{17}_1$ to $\mathbf{17}_n$ in the j-th horizontal period by corresponding to the control data $AS_{j,1}$ to $AS_{j,n}$.

Due to the drive capability control thus described, the drive capabilities of the respective operational amplifiers are appropriately controlled during the j-th horizontal period in response to the differences between the electrical potential of the data lines $X_1$ to $X_n$, when the data lines $X_1$ to $X_n$ are short-circuited, and the electrical potential levels to which the respective data lines are driven thereafter.

When the liquid crystal display device 10B is designed so that all the data lines $X_1$ to $X_n$ are short-circuited, it is preferable to calculate the control data $AS_{j,1}$ to $AS_{j,n}$ by the LCD controller 2B in order to simplify the circuit configuration of the data driver 3B. As understood from Formulae (2a) and (2b), it is necessary in this embodiment to prepare the pixel data associated with all the data lines $X_1$ to $X_n$ for the generation of each of the control data $AS_{j,1}$ to $AS_{j,n}$. An attempt to implement such calculations inside the data driver 3B may complicate the circuit configuration of the data driver 3B. Collective calculation of the control data $AS_{j,1}$ to $AS_{j,n}$ in the LCD controller 2B effectively avoids the complicated circuit configuration of the data driver 3B.

Figure 15:
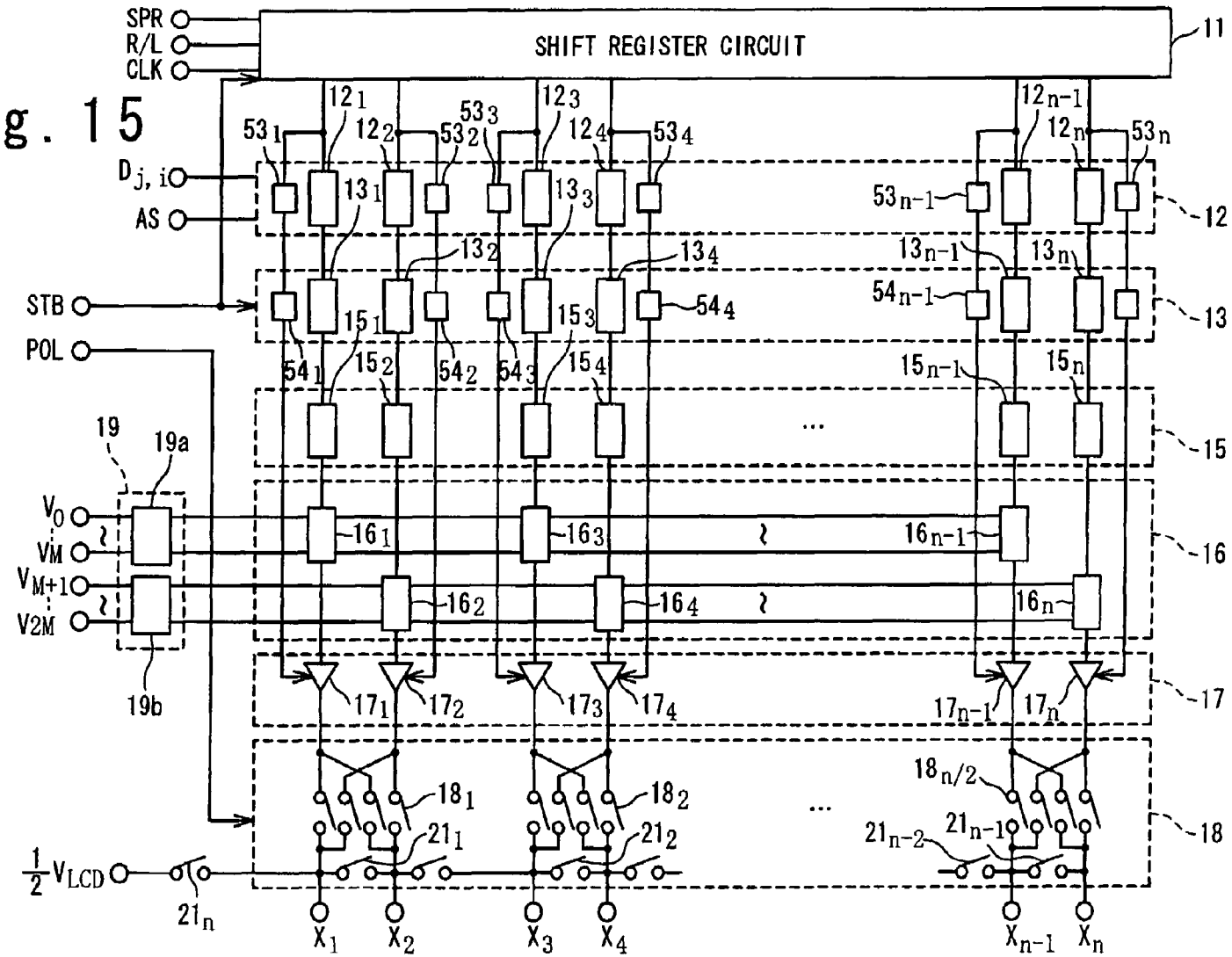
FIG. 15 is a block diagram showing another configuration of the data driver in the third embodiment.

As shown in FIG. 15, the data driver 3B may be configured so that the data lines $X_1$ to $X_n$ can be provided with an intermediate potential ½ $V_{LCD}$[=($V_1$+$V_{2M}$)/2] through a switch $\mathbf{21}_n$, when the data driver 3B is designed so that all the data lines $X_1$ to $X_n$ can be short-circuited.

In this case, the control data $AS_{j,1}$ to $AS_{j,n}$ used in the j-th horizontal period are expressed in formulae below, instead of the formulae (1a), (1b), (2a) and (2b):

$$AS_{j,2k-1}=|D_{1/2LCD}-D_{j,2k-1}|, \text{ and} \tag{3a}$$

$$AS_{j,2k}=|D_{1/2LCD}-D_{j,2k}|, \tag{3b}$$

where $D_{1/2LCD}$ is a fixed grayscale level value corresponding to the intermediate potential ½$V_{LCD}$. When the intermediate electrical potential ½$V_{LCO}$ is identical to the common potential $V_{COM}$, $D_{1/2LCD}$ may be set to zero. The control data $AS_{j,1}$ to $AS_{j,n}$ are thus calculated so that the drive capabilities of the respective operational amplifiers in the j-th horizontal period are appropriately controlled in response to the differences between the potential level of the data lines $X_1$ to $X_n$ when the data lines $X_1$ to $X_n$ are short-circuited, and the potential levels to the respective data lines are driven, thereafter.

CONCLUSION

As described above, the liquid crystal display device controls the drive capabilities of the operational amplifiers in response to the differences between the potential level of adjacent two or all of the data lines when they are short-circuited in the blanking period and the potentials to the respective data lines are driven thereafter. This effectively reduces the power consumption of the liquid crystal display device.

It is apparent that the present invention is not limited to the above-described embodiments, which may be modified and changed without departing from the scope of the invention. For example, the present invention is not limited to the configuration in which two data lines are short-circuited or the configuration in which all the data lines are short-circuited. In a liquid crystal display device adapted to a dot inversion drive that inverts the polarities of data signals at a spatial cycle of two pixels, for example, the data driver may be designed to short-circuit every four data lines including two data lines driven to positive potential levels and two data lines driven to negative potential levels.

What is claimed is:

1. A liquid crystal display device, comprising:

first and second data lines;

a first operational amplifier configured to drive said first data line to a potential of a first polarity during a first period, and to drive said second data line to a potential of said first polarity during a second period following said first period;

a second operational amplifier configured to drive said second data line to a potential of a second polarity complementary to said first polarity during said first period, and to drive said first data line to a potential of said second polarity during said second period; and a short-circuiting circuit configured to short-circuit said first and second data lines during a short-circuiting period between said first and second periods, wherein drive capabilities of said first and second operational amplifiers are controlled in response to a short-circuit potential of said first and second data lines during said short- circuiting period, wherein said drive capability of said first operational amplifier during said second period is controlled in response to a difference between said short-circuit potential and a potential to which said second data line is driven during said second period, and wherein said drive capability of said second operational amplifier during said second period is controlled in response to a difference between said short-circuit potential and a potential to which said first data line is driven during said second period.

2. The liquid crystal display device according to claim 1, further comprising a plurality of drive-capability switching circuits configured to generate control data for controlling a respective one of the first operational amplifier and the second operational amplifier, said drive-capability switching circuits generating control data in response to a difference between a potential level of a respective data line during the first period when the respective data lines are short-circuited during a blanking period of the second period.

3. The liquid crystal display device according to claim 2, wherein the drive-capability switching circuits each comprise a potential difference calculation circuit configured to receive pixel data of the first period and pixel data of the second period to generate control data on a basis of the pixel data of the first period and the pixel data of the second period for a respective data line.

4. The liquid crystal display device according to claim 1, wherein, in the short- circuiting period, said short-circuiting circuit short-circuits every adjacent two data lines to said first and second data lines.

5. The liquid crystal display device according to claim 1, wherein said drive capabilities of said first and second operational amplifiers are controlled based on a difference between said short-circuit potential of said first and second data lines during said short-circuiting period and a potential level of said first and second data lines during a next time period after said short-circuiting period.

6. The liquid crystal display device according to claim wherein a potential of said first and second data lines in said first period is latched during said short-circuiting period and said latched short-circuit potential of said first and second data lines is compared to said potential of said second polarity during said second period.

7. A liquid crystal display device, comprising:

first and second data lines;

a first operational amplifier configured to drive said first data line to a potential of a first polarity during a first period, and to drive said second data line to a potential of said first polarity during a second period following said first period;

a second operational amplifier configured to drive said second data line to a potential of a second polarity complementary to said first polarity during said first period, and to drive said first data line to a potential of said second polarity during said second period; and a short-circuiting circuit configured to short-circuit said first and second data lines during a short-circuiting period between said first and second periods, wherein drive capabilities of said first and second operational amplifiers are controlled in response to a short-circuit potential of said first and second data lines during said short- circuiting period, wherein said first operational amplifier is responsive to first pixel data for driving said first data line during said first period, and is responsive to second pixel data for driving said second data line during said second period, wherein said second operational amplifier is responsive to third pixel data for driving said second data line during said first period, and is responsive to fourth pixel data for driving said first data line during said second period, wherein said drive capability of said first operational amplifier during said second period is controlled in response to said second pixel data in addition to said short-circuit potential, and wherein said drive capability of said second operational amplifier during said second period is controlled in response to said fourth pixel data in addition to said short-circuit potential.

8. The liquid crystal display device according to claim 7, wherein said drive capability of said first operational amplifier during said second period is controlled in response to said first and third pixel data in addition to said second pixel data, and wherein said drive capability of said second operational amplifier during said second period is controlled in response to said first and third pixel data in addition to said fourth pixel data.

9. The liquid crystal display device according to claim 8, wherein said first polarity is positive, wherein said first operational amplifier provides output potential levels for said first and second data lines so that said output potential levels are increased as an increase in values of said first and second pixel data, wherein said second polarity is negative, and wherein said second operational amplifier provides output potential levels for said first and second data lines so that said output potential levels are decreased as an increase in values of said third and fourth pixel data, wherein said drive capability of said first operation amplifier during said second period is controllable in response to a difference between a half of a difference between values of said first and third pixel data and a value of said second pixel data, and wherein said drive capability of said second operation amplifier during said second period is controllable in response to a difference between a half of a difference between values of said first and third pixel data and a value of said fourth pixel data.

10. The liquid crystal display according to claim 8, further comprising an LCD controller feeding said first to fourth pixel data, wherein said first and second operational amplifiers are provided in a data driver prepared separately from said LCD controller, wherein said LCD controller generates first control data in response to said first to third pixel data to feed said first control data to said data driver, and generates second control data in response to said first, second, and fourth pixel data to feed said second control data to said data driver, wherein said drive capability of said first operation amplifier during said second period is controlled in response to said first control data, and wherein said drive capability of said second operation amplifier during said second period is controlled in response to said second control data.

11. A liquid crystal display device, comprising:

a plurality of data lines including:

a plurality of first data lines; and a plurality of second data lines;

a plurality of first operational amplifiers responsive to first pixel data for providing positive data signals of a positive polarity for said first data lines during a first period, and responsive to second pixel data for providing positive data signals of said positive polarity for said second data lines during a second period following said first period;

a plurality of second operational amplifiers responsive to third pixel data for providing negative data signals of a negative polarity for said second data lines during said first period, and responsive to fourth pixel data for providing negative data signals of said negative polarity for said first data lines during said second period; and a short-circuiting circuit configured to short-circuit said plurality of data lines during a short-circuiting period between said first and second period, wherein drive capabilities of said first operational amplifiers during said second period are controlled in response to a potential of said plurality of data lines during said short- circuiting period and associated ones of said second pixel data, wherein drive capabilities of said second operational amplifiers during said second period are controlled in response to said potential of said plurality of data lines during said short-circuiting period and associated ones of said fourth pixel data, and wherein said drive capabilities of said first and second operational amplifiers during said second period are controlled in response to said first and third pixel data.

12. The liquid crystal display device according to claim 11, further comprising an LCD controller feeding said first to fourth pixel data, wherein said first and second operational amplifiers are provided in a data driver prepared separately from said LCD controller, wherein said LCD controller generates first control data associated with said first operational amplifiers, respectively, in response to all of the said first and third pixel data and to associated ones of said second pixel data to feed said first control data to said data driver, and generates second control data associated with said first operational amplifiers, respectively, in response to all of said first and third pixel data, and to associated ones of said fourth pixel data to feed said second control data to said data driver, wherein said drive capabilities of said first operation amplifiers during said second period are controlled in response to said first control data, and wherein said drive capabilities of said second operation amplifiers during said second period are controlled in response to said second control data.

13. A liquid crystal display device, comprising:

first and second data lines;

a first operational amplifier responsive to first pixel data for providing a data signal of a first polarity for one of said first and second data lines during a first period, and responsive to second pixel data for providing a data signal of said first polarity for another of said first and second data lines during a second period following said first period;

a second operational amplifier responsive to third pixel data for providing a data signal of a second polarity complementary to said first polarity for said another of said first and second data lines during said first period, and responsive to second pixel data for providing a data signal of said second polarity for said one of said first and second data lines; and a short-circuiting circuit configured to short-circuit said first and second data lines during a short-circuiting period between said first and second periods, wherein drive capabilities of said first and second operational amplifiers are controlled in response to said first and third pixel data, wherein said drive capability of said first operational amplifier during said second period is controlled in response to said first to third pixel data, and wherein said drive capability of said second operational amplifier during said second period is controlled in response to said first, third, and fourth pixel data.

14. A liquid crystal driver, comprising:

first and second output terminals to be connected with first and second data lines, respectively;

a first operational amplifier responsive to first pixel data for providing a data signal of a first polarity for selected one of said first and second output terminals during a first period, and responsive to second pixel data for providing a data signal of said first polarity for the other of said first and second output terminals during a second period following said first period;

a second operational amplifier responsive to third pixel data for providing a data signal of a second polarity complementary to said first polarity for said other of said first and second output terminals during said first period, and responsive to fourth pixel data for providing a data signal of said second polarity for said one of said first and second output terminals during said second period; and a short-circuiting circuit configured to short-circuit said first and second output terminals during a short-circuiting period between said first and second periods, wherein drive capabilities of said first and second operational amplifiers during said second period are controlled in response to said first and third pixel data, wherein said drive capability of said first operational amplifier during said second period is controlled in response to said first to third pixel data, and wherein said drive capability of said second operational amplifier during said second period is controlled in response to said first, third and fourth pixel data.

15. A method for driving a liquid crystal display panel, said method comprising:

driving a first data line to a first potential level of a first polarity by using a first operational amplifier, and a second data line to a second potential level of a second polarity complementary to said first polarity by using a second operational amplifier, during a first period;

driving said second data line to a third potential level of said first polarity by using said first operational amplifier, and said first data line to a fourth potential level of said second polarity, by said second operational amplifier during a second period following said first period; and short-circuiting said first and second data lines during a short-circuiting period between said first and second periods, wherein drive capabilities of said first and second operational amplifiers used for driving said first and second data lines, respectively during said second period are controlled in response to a short-circuit potential of said first and second data lines during said short- circuiting period, wherein said drive capability of said first operational amplifier during said second period is controlled in response to a difference between said short-circuit potential and said third potential level, and wherein said drive capability of said second operational amplifier during said second period is controlled in response to a difference between said short-circuit potential and said fourth potential level.

* * * * *

UNITED STATES PATENT AND TRADEMARK OFFICE

CERTIFICATE OF CORRECTION

PATENT NO. : 7,710,373 B2
APPLICATION NO. : 11/398547
DATED : May 4, 2010
INVENTOR(S) : Takashi Nose It is certified that error appears in the above-identified patent and that said Letters Patent is hereby corrected as shown below:

Column 19, line 1 should read:

6. The liquid crystal display device according to claim 1, wherein a potential of said first and second data lines in said first period is latched during said short-circuiting period and said latched short-circuit potential of said first and second data lines is compared to said potential of said second polarity during said second period.

Signed and Sealed this

Twenty-first Day of September, 2010

David J. Kappos

David J. Kappos
*Director of the United States Patent and Trademark Office*